US009530350B2

(12) United States Patent
Cho et al.

(10) Patent No.: US 9,530,350 B2
(45) Date of Patent: Dec. 27, 2016

(54) DISPLAY PANEL

(71) Applicant: SAMSUNG DISPLAY CO., LTD., Yongin, Gyeonggi-Do (KR)

(72) Inventors: Se Hyoung Cho, Hwaseong-si (KR); Joon-Chul Goh, Hwaseong-si (KR); Jang Mi Kang, Bucheon-si (KR); Sung Hwan Kim, Yongin-si (KR); Il Gon Kim, Seoul (KR); Sang Hyeon Song, Seoul (KR); Mee Hye Jung, Suwon-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 3 days.

(21) Appl. No.: 14/547,521

(22) Filed: Nov. 19, 2014

(65) Prior Publication Data

US 2016/0005357 A1 Jan. 7, 2016

(30) Foreign Application Priority Data

Jul. 2, 2014 (KR) ..... 10-2014-0082614

(51) Int. Cl.
*G09G 5/00* (2006.01)
*G09G 3/32* (2016.01)
*G09G 3/36* (2006.01)

(52) U.S. Cl.
CPC ..... *G09G 3/3233* (2013.01); *G09G 3/3677* (2013.01); *G09G 2300/0819* (2013.01); *G09G 2310/08* (2013.01); *G09G 2320/0223* (2013.01); *G09G 2320/0252* (2013.01)

(58) Field of Classification Search
CPC .. G09G 3/3208; G09G 3/3233; G09G 3/3677; G09G 2300/0819; G09G 2310/08; G09G 2310/068; G09G 2320/0252
See application file for complete search history.

(56) References Cited

U.S. PATENT DOCUMENTS 5,602,560 A * 2/1997 Ikeda ..... G09G 3/3648 345/58
6,100,865 A * 8/2000 Sasaki ..... G09G 3/3648 345/100
6,850,289 B2 * 2/2005 Lee ..... G09G 3/3648 257/202
6,862,013 B2 * 3/2005 Takeuchi ..... G09G 3/3677 345/100
8,217,926 B2 7/2012 Meng
2005/0266590 A1 * 12/2005 Roh ..... G02F 1/167 438/22
2008/0122875 A1 * 5/2008 Qi ..... G09G 3/3677 345/690

(Continued)

FOREIGN PATENT DOCUMENTS

KR 10-2002-0038304 A 5/2002
KR 10-0511254 8/2005

*Primary Examiner* — Joe H Cheng
(74) *Attorney, Agent, or Firm* — Lee & Morse, P.C.

(57) ABSTRACT

A display panel includes a gate line extending in a column direction, a data line extending in a row direction, a pixel including a switching transistor connected to the gate line and the data line, and a voltage applier connected to a gate line of a present stage. The voltage applier to apply a voltage after conversion of the gate-on voltage to a gate-off voltage has started. The voltage is closer to the gate-on voltage than the gate-off voltage.

11 Claims, 34 Drawing Sheets

(56) References Cited

U.S. PATENT DOCUMENTS

| | | | | |
|---|---|---|---|---|
| 2010/0001983 | A1* | 1/2010 | Abe | G09G 3/3233 345/211 |
| 2011/0018846 | A1* | 1/2011 | Hu | G02F 1/136286 345/204 |
| 2012/0044270 | A1* | 2/2012 | Arkhipov | G09G 3/32 345/690 |
| 2012/0098816 | A1* | 4/2012 | Lee | G09G 3/3648 345/212 |
| 2012/0268676 | A1* | 10/2012 | Kim | G09G 3/3659 349/38 |
| 2014/0139510 | A1* | 5/2014 | Han | G09G 3/3233 345/212 |
| 2014/0152633 | A1* | 6/2014 | Park | G09G 3/3291 345/207 |
| 2014/0285462 | A1* | 9/2014 | Lee | G09G 3/3648 345/173 |
| 2015/0084946 | A1* | 3/2015 | Shim | G09G 3/3258 345/212 |
| 2015/0187273 | A1* | 7/2015 | Chang | G09G 3/3233 345/690 |

* cited by examiner

DISPLAY PANEL

CROSS-REFERENCE TO RELATED APPLICATION

Korean Patent Application No. 10-2014-0082614, filed on Jul. 2, 2014, entitled, "Display Panel," is incorporated by reference herein in its entirety.

BACKGROUND

1. Field

One or more embodiments described herein relate to a display panel.

2. Description of the Related Art

A variety of flat panel displays have been developed. One type of flat panel display is a liquid crystal display. A liquid crystal display has a liquid crystal layer between two panels, on which field generating electrodes (such as pixel electrodes) and a common electrode are respectively formed. When a voltage is applied to the field generating electrodes, an electric field is formed in the liquid crystal layer to align liquid crystal molecules therein, to thereby form an image. Other examples of flat panel displays include organic light emitting panels, plasma display panels, and electrophoretic display panels.

These displays typically include a gate driver and a data driver. During fabrication, the gate driver may be patterned along with the gate line, the data line, and thin film transistors to form an integrated panel.

SUMMARY

In accordance with one embodiment, a display panel including a gate line extending in a column direction; a data line extending in a row direction; a pixel including a switching transistor connected to the gate line and the data line; and a voltage applier connected to a gate line of a present stage, the voltage applier to apply a voltage after conversion of the gate-on voltage to a gate-off voltage has started, wherein the voltage is closer to the gate-on voltage than the gate-off voltage.

The voltage applier may include a transistor having a control terminal connected to a control wire to transmit a gate-off voltage applying signal, a source terminal to receive the gate-off voltage, and a drain terminal connected to the gate line of a present line. The gate-on voltage may be applied to the gate line of the present stage partially overlaps a gate line at a previous stage of the gate line of the present stage or a gate line at a next stage.

The control wire which transmits the gate-off voltage applying signal may include an odd-numbered control wire to control the voltage applier connected to an odd-numbered gate line, and an even-numbered control wire to control the voltage applier connected to an even-numbered gate line. The control wire that transmits the gate-off voltage applying signal may include a first control wire, a second control wire, and a third control wire, wherein gate-off voltage applying signals that are applied to the first control wire, the second control wire, and the third control wire do not overlap each other.

The control wire may be parallel to the data line. The pixel may include a liquid crystal capacitor. The pixel may include a driving transistor and a light emitting diode.

The voltage applier may include a transistor having a control terminal connected to a gate line of a next stage, a source terminal to receive the gate-off voltage, and a drain terminal connected to the gate line of the present stage. The gate-on voltage that is applied to the present stage does not overlap the gate-on voltage applied to a gate line of a previous stage or a next stage.

The voltage applier may include a transistor having a control terminal connected to a gate line of a next stage, a source terminal connected to a gate line of a previous stage, and a drain terminal connected to the gate line of the present stage.

The gate-on voltage applied to the present stage does not overlap the gate-on voltage applied to a gate line of a previous stage or a next stage. The voltage applier may include a first gate-off voltage applying transistor, a second gate-off voltage applying transistor, and a capacitor, and wherein a gate line of a previous stage is connected to a source terminal of the first gate-off voltage applying transistor, the gate line of the present stage is connected to a drain terminal of the first gate-off voltage applying transistor, a gate terminal of the first gate-off voltage applying transistor is connected to a first node, the gate line of the present stage is connected to a source terminal of the second gate-off voltage applying transistor, the first node is connected to a drain terminal of the second gate-off voltage applying transistor, a gate terminal of the second gate-off voltage applying transistor is connected to a gate line of a next stage, and the capacitor is connected between a ground terminal and the first node.

The gate-on voltage applied to the present stage may partially overlap the gate-on voltage applied to a gate line of a previous stage or a next stage. The pixel may include a driving transistor and a light emitting diode (LED), and wherein one end of the driving transistor is coupled to receive a power source voltage. A voltage level of the gate-on voltage may be lower than that of the gate-off voltage.

The voltage applier may include a transistor having a control terminal connected to a gate line of a next stage, a source terminal to receive the power source voltage, and a drain terminal connected to the gate line of the present stage. The gate-on voltage applied to the present stage may not overlap the gate-on voltage applied to a gate line of a previous stage or a next stage.

The power source voltage may have a voltage level higher than the gate-on voltage and lower than the gate-off voltage, and may be closer to a voltage level of the gate-off voltage. The voltage applier includes at least one voltage applier connected to the gate line of the present stage.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
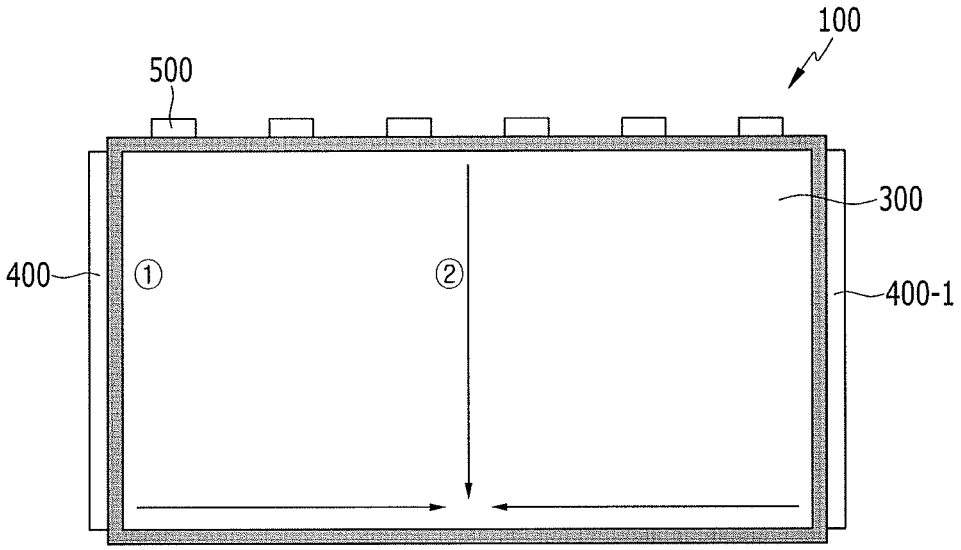
FIG. 1 illustrates an embodiment of a display panel.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawings, the dimensions of layers and regions may be exaggerated for clarity of illustration. Like reference numerals refer to like elements throughout.

FIG. 1 is a front view of one embodiment of a display panel 100 which includes a display area 300 for displaying an image, gate drivers 400 and 400-1 for applying a gate voltage to a gate line of the display area 300, and a data driver 500 for applying a data voltage to a data line of the display area 300. The gate drivers 400 and 400-1 and the data driver 500 are controlled by a signal controller.

Referring to FIG. 1, the gate drivers 400 and 400-1 are at respective left and right sides of the display area 300. The data driver 500 is disposed at upper side of the display area 300. As a result, the gate voltage is applied from the left side and the right side of the display area 300, and the data voltage is applied from the upper side of the display area 300. This is illustrated by arrows in FIG. 1.

A plurality of pixels are formed in the display area 300. The display panel 100 may be, e.g., a flat display panel such as a liquid crystal panel and an organic light emitting diode panel. When display panel 100 is a liquid crystal panel, the display panel 100 includes a thin film transistor Q and a liquid crystal capacitor Clc. When the display panel 100 is an organic light emitting diode panel, the display panel 100 includes switching thin film transistors TRs, driving thin film transistors TRd, and an organic light emitting diodes. In this specification, when there is no description related to which of the two kinds of panels is applicable, it may be understood that the features being discussed are applicable to both types of panels.

Figure 2:
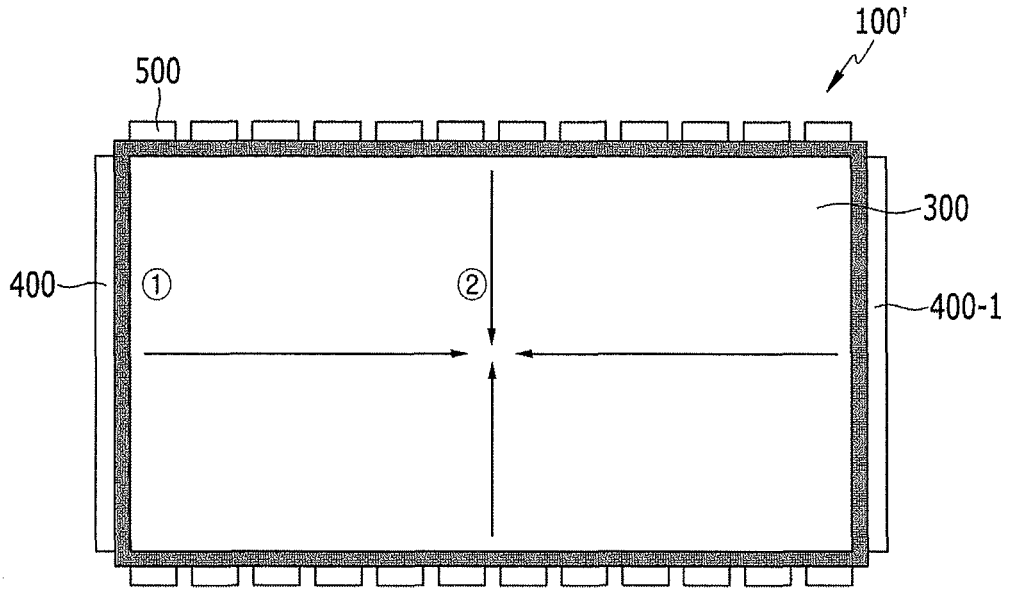
FIG. 2 illustrates another embodiment of a display panel.

FIG. 2 is a front view of another embodiment of a display panel 100'. In contrast to FIG. 1, in the display panel 100' in FIG. 2, data drivers 500 are at an upper side and a lower side thereof. As a result, in the display panel 100' in FIG. 2, the data voltage is applied from the upper side and the lower side of the display area 300, which is illustrated by arrows in FIG. 1.

Figure 3:
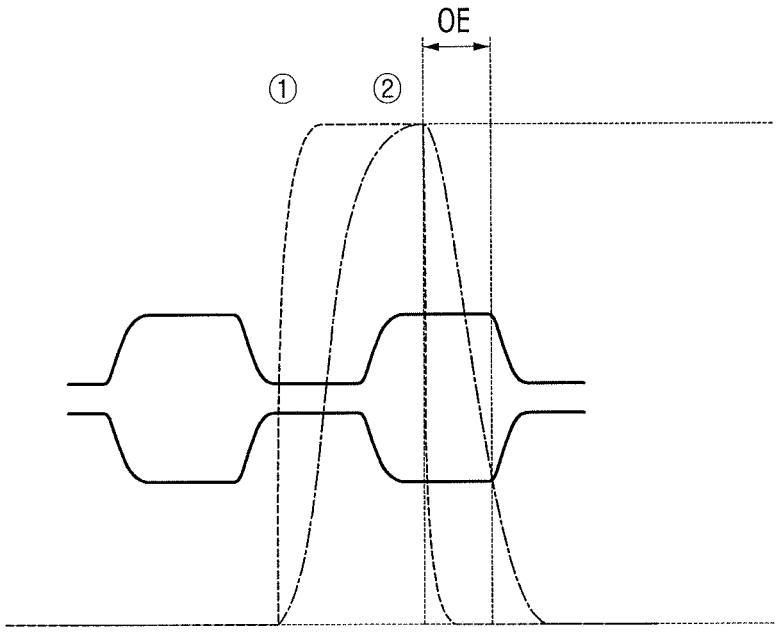
FIG. 3 illustrates an example of a delay of a gate signal based on a position.

FIG. 3 illustrates one type of delay of a gate signal that may occur based on position. In FIG. 3, the delay of the gate signal corresponds to a first position ① and a second position ② in the display area 300 in FIGS. 1 and 2.

For example, a first distance from the data driver 500 to the first position ① is the same as a second distance from the data driver 500 to the second position ②. Thus, a data voltage is applied thereto with a same timing. However, a third distance from the gate driver 400 to the first position ① is different from a fourth distance from the gate driver 400 to the second position ②. Accordingly, a non-delayed gate signal (hereinafter referred to as a gate signal ①) is applied to the first position ①, while a delayed gate signal (hereinafter referred to as a gate signal ①) is applied to the second position ②.

Referring to FIG. 3, the gate signal ② is not formed to have a square-wave shape due to the delay, and has a gradually increasing voltage. For example, when the voltage of the gate signal ① rapidly increases, the gate signal ② smoothly increases. Further, when the voltage of the gate signal ① rapidly decreases, the gate signal ② smoothly decreases.

In FIG. 3, it is illustrated that off timing of the gate signal ② is delayed by a time OE compared with the gate signal ①. As a result, a problem may occur as a next voltage is applied. In the case where a signal is delayed like the gate signal ②, a problem occurs as a gate-on signal is still applied even at the time when a gate-off voltage needs to be applied. In accordance with one or more embodiments described herein, the problem of delay in the gate-off timing caused by the signal delay may be resolved.

Figure 4:
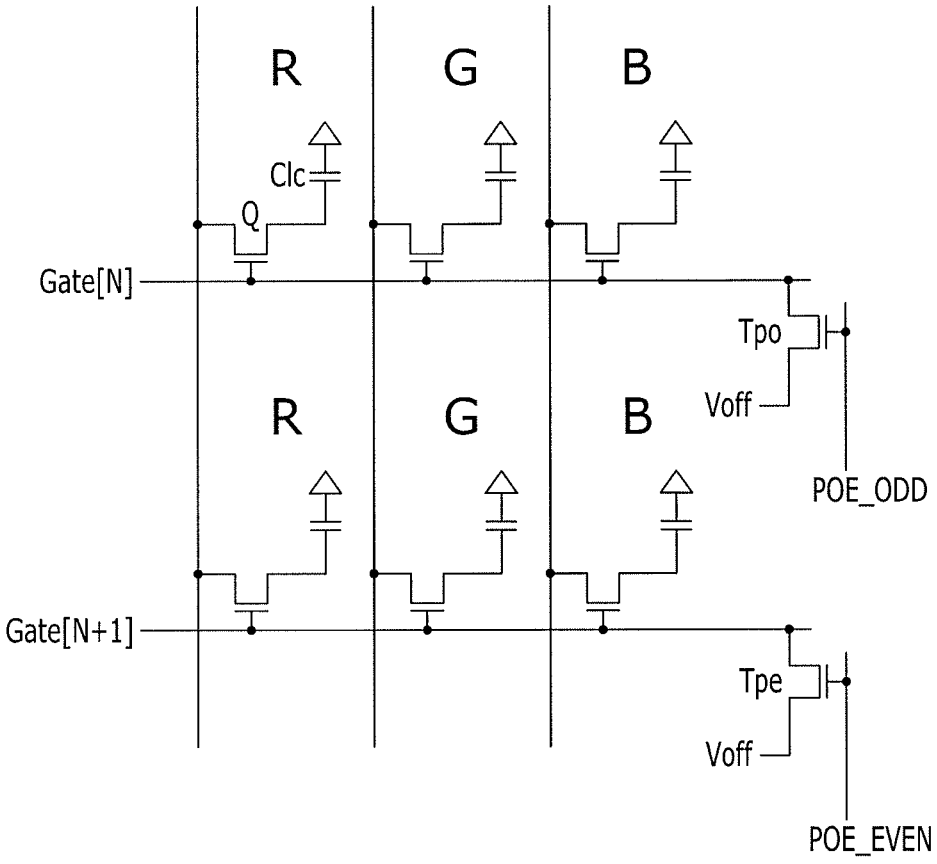
FIG. 4 illustrates an embodiment including pixels of a display panel.
Figure 5:
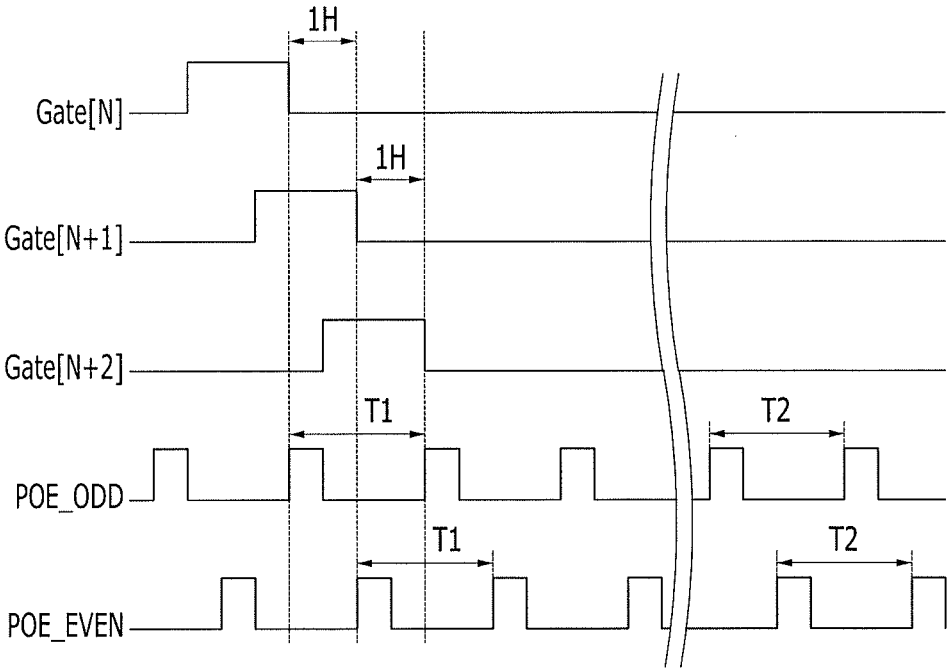
FIG. 5 illustrates an example of a signal transferred from the display panel.

FIG. 4 illustrates an example of a plurality of pixels of a display panel, and FIG. 5 is a waveform diagram illustrating an example of a signal transferred from the display panel of FIG. 4. The circuit diagram of FIG. 4 is for a liquid crystal display panel.

Referring to FIG. 4, the liquid crystal panel includes a plurality of pixels arranged in a matrix of rows and columns. The pixels include color filters R, G, and B, and each column has filters of a same color. Each pixel includes a thin film transistor Q and a liquid crystal capacitor Clc. The thin film transistor Q has a gate terminal connected to a gate line, a source terminal connected to a data line, and a drain terminal connected to one end of the liquid crystal capacitor Clc. A common voltage is applied to the other end of the liquid crystal capacitor Clc. In another embodiment, each pixel may include an organic capacitor.

The red, green, and blue pixels arranged in a column direction constitute one unit pixel. In other words, each unit pixel includes different color pixels, or sub-pixels.

One gate-off voltage applier 600 is connected to each gate line per unit pixel. The gate-off voltage applier 600 applies a voltage for turning off the thin film transistor Q, and includes gate-off voltage applying transistors Tpo and Tpe.

Gate terminals of the gate-off voltage applying transistors Tpo and Tpe are respectively connected to control wires POE_ODD and POE_EVEN for transferring a gate-off voltage applying signal, the gate-off voltage is applied to source terminals thereof, and drain terminals thereof are connected to the gate line.

In the present embodiment, the gate-off voltage applier 600 is described to be formed per unit pixel, but two or more of gate-off voltage appliers 600 may be connected to one gate line in another embodiment.

The gate-off voltage appliers 600 are divided into odd-numbered gate-off voltage appliers 600 that are respectively connected to odd-numbered gate lines, and even-numbered gate-off voltage appliers 600 that are respectively connected to even-numbered gate lines. All the odd-numbered gate-off voltage appliers 600 are connected to the control wire POE_ODD. All the even-numbered gate-off voltage appliers 600 are connected to the control wire POE_EVEN. In other words, all the odd-numbered gate-off voltage appliers 600 apply the gate-off voltage to the odd-numbered gate lines with the same timing. All the even-numbered gate-off voltage appliers 600 apply the gate-off voltage to the even-numbered gate lines with the same timing.

FIG. 5 illustrates signals applied to an odd-numbered control wire and an even-numbered control wire. Referring to FIG. 5, gate-on voltages (e.g., high-level voltages) are sequentially applied to the respective gate lines. In the present embodiment, the gate-on voltages that are applied to the respective gate lines overlap each other. Specifically, the gate-on voltages that are applied to adjacent gate lines overlap each other. A maintaining time of the gate-on voltage is longer than a period 1H. For example, the time during which the gate-on voltage is applied is the period 1H, excluding the time during which the present gate-on voltage overlaps a preceding gate-on voltage. Further, the gate-on voltages applied to even-numbered gate lines do not overlap each other, and the gate-on voltages applied to odd-numbered gate lines do not overlap each other.

In this case, a control signal (hereinafter referred to as an even-numbered control signal) applied to a present even-numbered control wire is converted to a high-level voltage after the gate-on voltage is applied to the present even-numbered gate line, and is converted to a low-level voltage before the gate-on voltage is applied to a next even-numbered gate line. As a result, one frame may include a plurality of high-level voltages, the number of which may be a half or another fraction of a total number of gate lines.

Similarly, a control signal (hereinafter referred to as an odd-numbered control signal) applied to a present odd-numbered control wire is converted to a high-level voltage after the gate-on voltage is applied to the present odd-numbered gate line, and is converted into a low-level voltage before the gate-on voltage is applied to a next odd-numbered gate line. As a result, one frame may include a plurality of high-level voltages, the number of which may be a half or another fraction of the total number of gate lines.

When the control signal is applied, the gate-off voltage is applied to all the pixels connected to the even-numbered gate lines through the gate-off voltage appliers 600, after the gate-on voltage is applied to one of the even-numbered gate lines. The gate-off voltage applied to all the pixels connected to the odd-numbered gate lines through the gate-off voltage appliers 600, after the gate-on voltage is applied to one of the odd-numbered gate lines.

Accordingly, by the action of the gate-off voltage appliers 600, none of the pixels encounter any problem caused by delay, as the gate-off voltage (low-level voltage) is quickly maintained after the gate-on voltage is applied.

Figure 6:
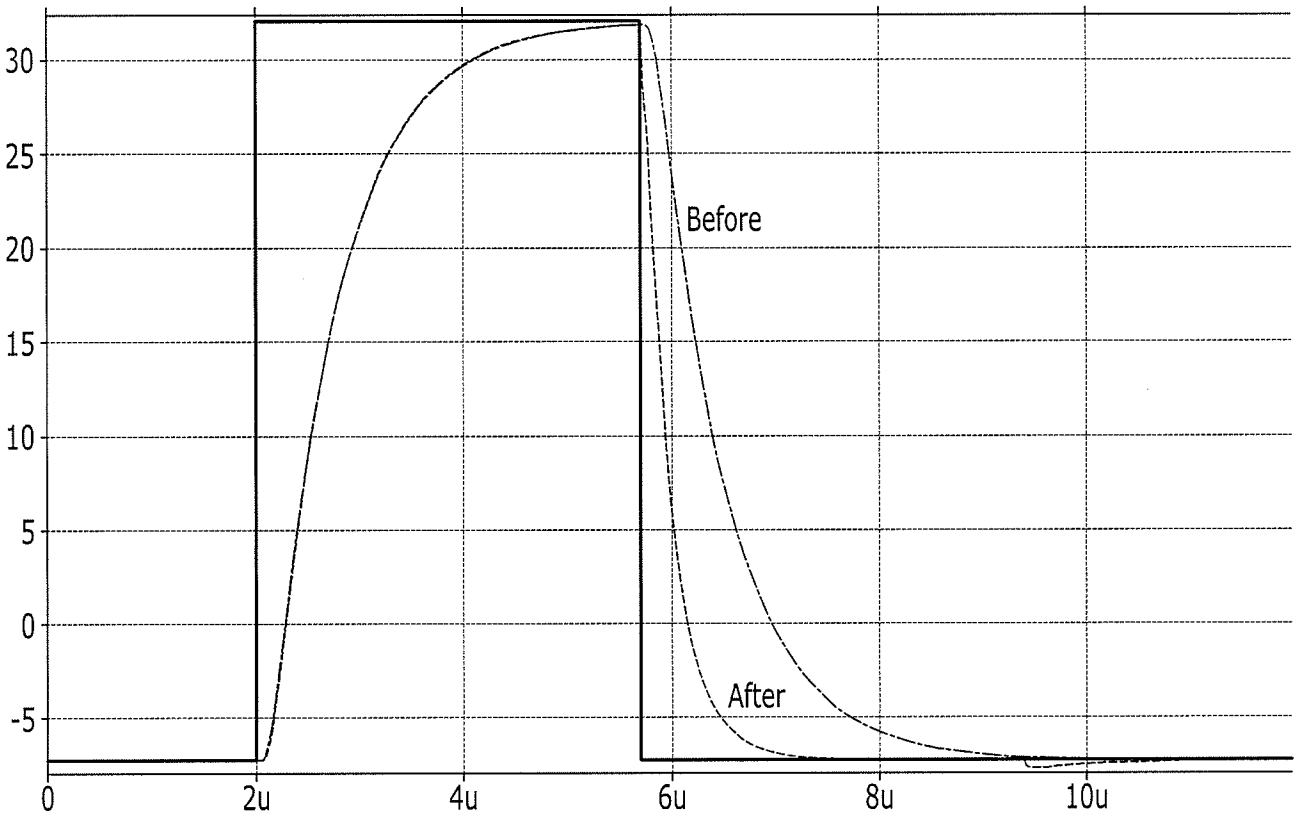
FIGS. 6 and 7 illustrate examples of gate signals from a display panel.
Figure 7:
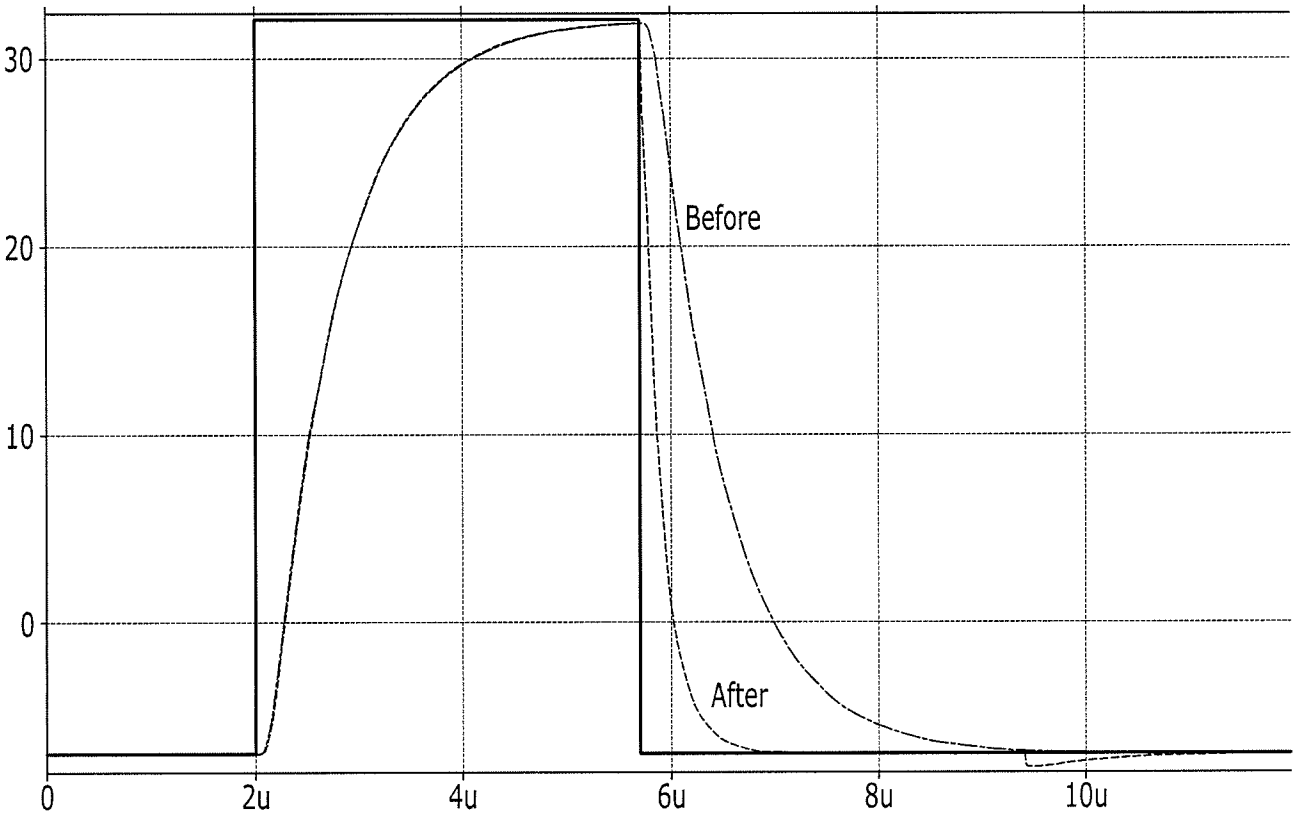

FIGS. 6 and 7 illustrate examples of waveforms of gate signals transferred from a display panel. The waveforms in FIG. 6 and FIG. 7 correspond to different conditions.

The waveforms in FIG. 6 correspond to the case where the time 1H (e.g., the time during which the gate-on voltage is applied) is set as 3.7 μs. Also, the resistance of the gate line is 2 kΩ, the capacitance of the gate line is 800 pF, and the gate-off voltage applier 600 is disposed every two pixels. Further, the width and the length of a channel of the gate-off voltage applying transistor in the gate-off voltage applier 600 is 60 μm and 4 μm, and amorphous silicon is used as the semiconductor layer.

The waveforms in FIG. 7 correspond to the case where the same time 1H and the same resistance and capacitance of the gate line is used as in FIG. 6. Further, similar to FIG. 6, the gate-off voltage applier 600 is disposed at every two pixels, and amorphous silicon is used as the semiconductor layer in the gate-off voltage applying transistor. However, unlike FIG. 6, the width of the channel of the gate-off voltage applying transistor is 100 μm. The length of the channel is 4 μm like for FIG. 6.

From a comparison of FIGS. 6 and 7, it is apparent that the waveforms are substantially identical even though the widths of the channels of the gate-off voltage applying transistors are different. Also, the time used to convert the gate-on voltage to the gate-off voltage is reduced.

It has been described that the time that it takes to convert the gate-on voltage into the gate-off voltage is reduced by additionally forming the gate-off voltage applying transistor and using a control signal POE. However, the times at which the control signal POE is applied may vary according to the position of the pixels. This will be described with reference to FIG. 8 to FIG. 10.

Figure 8:
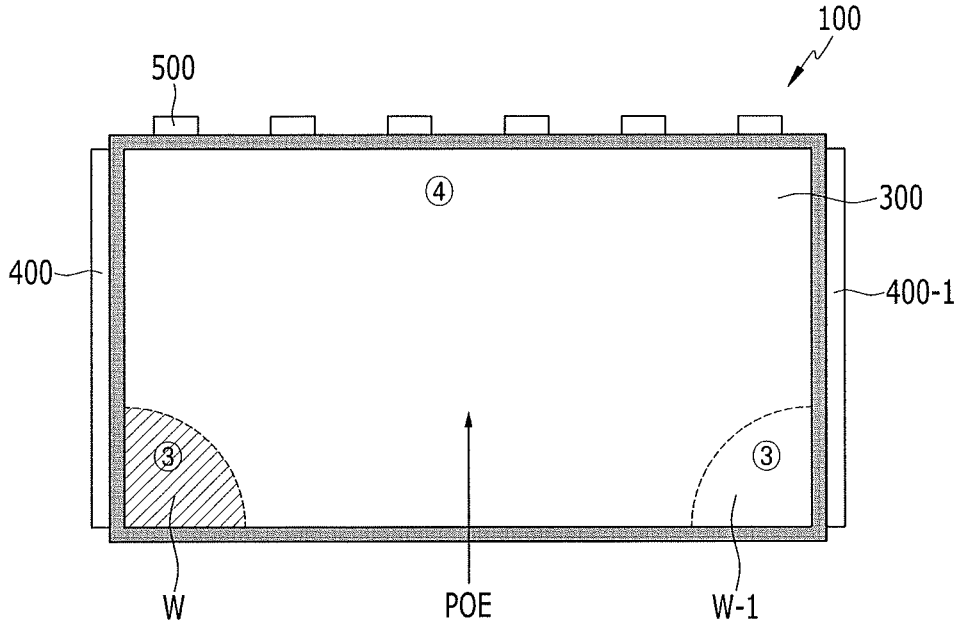
FIGS. 8 and 9 illustrate examples of application positions of a pixel output signal in a display panel.
Figure 9:
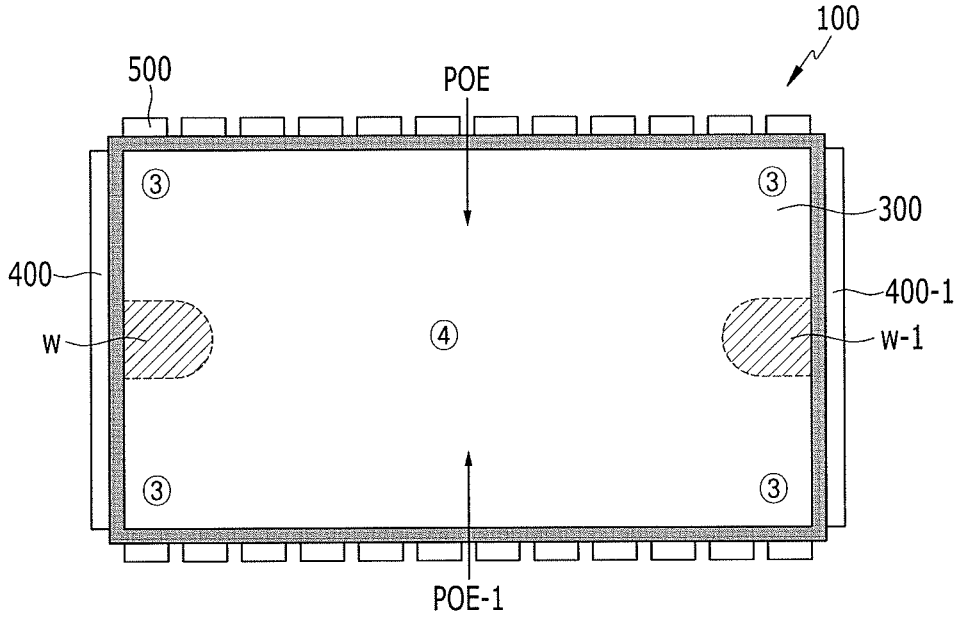
Figure 10:
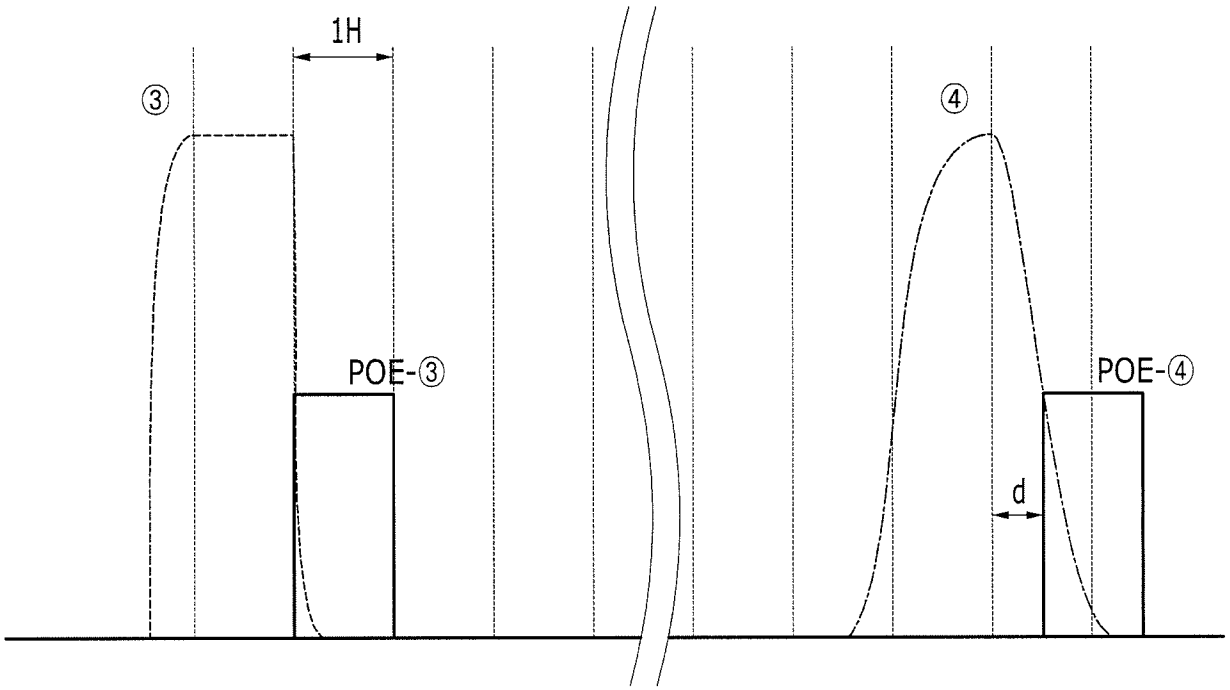
FIG. 10 illustrates a gate signal and a pixel output signal based on position.

FIGS. 8 and 9 are front views illustrating example of application positions of a pixel output signal in a display panel, and FIG. 10 is a graph illustrating a gate signal and a pixel output signal according to position. FIG. 8 and FIG. 9 respectively illustrate the display panels 100 and 100' corresponding to the embodiments of FIG. 1 and FIG. 2. Here, the positions at which the control signal POE is applied are differently defined.

Referring to FIG. 8, an example is illustrated in which the control signal POE is applied from a lower side that is opposite to the side of the data drivers 500. Referring to FIG. 9, an example is illustrated in which the data drivers 500 are disposed at respective upper and lower sides, and the control signal POE is applied from the upper and lower sides.

The timing at which the control signal POE is applied will be described based on FIG. 8. In FIG. 8, when the gate signals are output from the gate drivers 400 and 400-1, the gate signal that is most delayed is transferred to a predetermined position (e.g., the center at position ④) of the display panel 100. The gate signal that is not delayed is transferred to left and right sides (e.g., positions ③) of the display panel 100. For the gate signal transferred to the center position ④ of the display panel 100, it takes longer time to be converted to the gate-on voltage, and it also takes a long time to be converted to the gate-off voltage as shown in FIGS. 6 and 7. However, when converted to the gate-on voltage or the gate-off voltage, the gate signal transferred to the left and right sides (e.g., the positions ③) of the display panel 100 is hardly delayed.

In this case, when the control signal POE is applied from the lower side of the display panel 100, the control signals POE at the positions ③ and ④ have different delay characteristics. As a result, the control signal POE is applied to the positions ③ without delay, while the control signal POE is applied to the position ④ after being delayed for a long time.

As such, the graph of FIG. 10 shows the characteristics of the control signal POE and the gate signal. As shown in FIG. 10, the gate signal is hardly delayed and the control signal POE is also hardly delayed at the position ③. Accordingly, the conversion to off signals is performed with normal timing.

However, the gate signal and the control signal POE are delayed at position ④. Thus, the timing at which the gate-off voltage applying transistor is turned on is delayed. As shown in FIG. 10, the gate-off voltage applying transistor is delayed by a time "d" and is turned on.

As such, in the display panel 100, the time at which the gate-off voltage applying transistor is turned on may be varied according to the position due to the delay. Thus, it is possible to adjust the timing at which the control signal POE is applied in consideration of the delay. For example, a high-level voltage of the control signal POE may be output at the time d before a desired gate-off voltage timing in consideration of the time d delayed at the position ④. The timing at which the high-level voltage of the control signal POE is applied may be varied according to the position.

The embodiment of FIG. 9 is substantially the same as FIG. 8. However, because the positions from which the control signal POE is applied are different from each other, the positions ③ and ④ are different from each other. In the embodiment of FIG. 9, the relationships between the gate signal and the control signal POE at the positions ③ and ④ are the same as in FIG. 10.

The signals that are applied to the display panel 100 may also include a data voltage. If the delay of the data voltage is considered, a problem may be generated at areas w and w−1 in FIGS. 8 and 9. The area w or w−1 indicates an area to which a data voltage of another pixel may be applied as the gate signal is not delayed, but the data voltage is delayed.

In the display panels 100 of FIGS. 8 and 9, the gate drivers 400 and 400-1 are disposed at respective left and right sides. Thus, the gate signal is most quickly applied to the pixels at the left and right sides thereof. The delayed gate signal is applied to the center position ④ of the display panels 100.

In this case, when the data driver 500 receives the data voltage, the pixels adjacent to the data driver 500 most quickly receive the data voltage, and the pixels that are at a distance from the data driver 500 receive the delayed data voltage. As a result, the delayed data voltage is applied to the pixels farther from the data driver, i.e., at the lower side of the display panel 100 in the embodiment of FIG. 8. The delayed data voltage is applied to the pixels between the upper and lower sides of the display panel 100 in the embodiment of FIG. 9.

In the display panels 100, when the pixels receive the delayed gate signal and also receive the delayed data voltage, images are displayed according to the data voltage that is appropriate for the delayed timing. However, when the normal gate signal is applied, but the delayed data voltage is applied, a problem occurs as the pixels display images based on an inappropriate data voltage, which corresponds to the area w in the embodiment of FIG. 8 and the areas w and w−1 in the embodiment of FIG. 9.

Accordingly, the high-level section for the gate signal and the application timing of the data voltage may be adjusted to remove the problem that may occur in areas w and w−1. To that end, an inappropriate data voltage is prevented from being applied to the pixels, by setting an inverse timing of the data voltage and an increased timing of the gate-on voltage to not be identical to each other as in FIG. 3.

Hereinafter, embodiments different from FIG. 4 will be described with reference to FIG. 11 to FIG. 31. First, embodiments of FIGS. 11 and 12 will be described.

Figure 11:
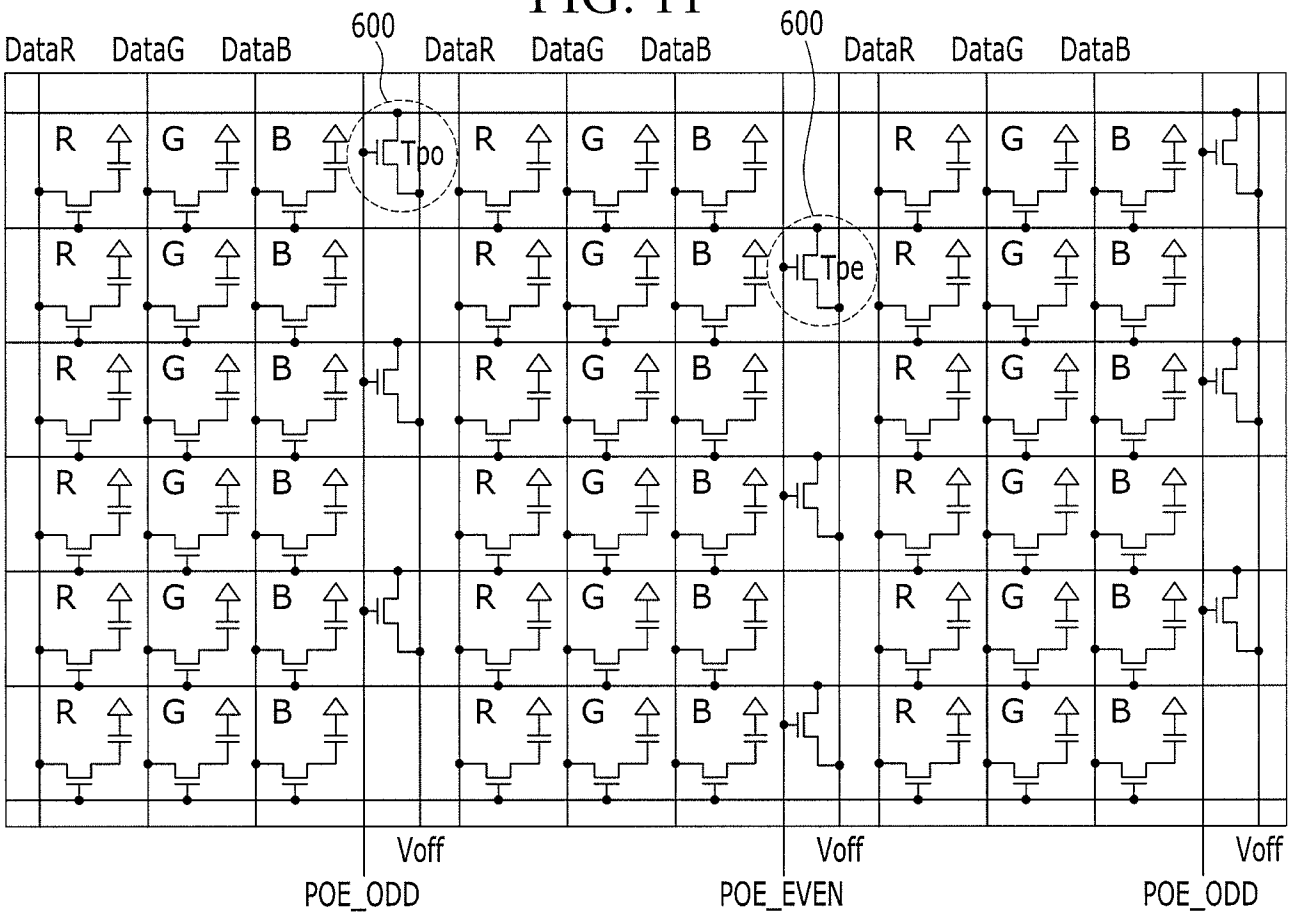
FIGS. 11 and 12 illustrate examples of pixels of a display panel.
Figure 12:
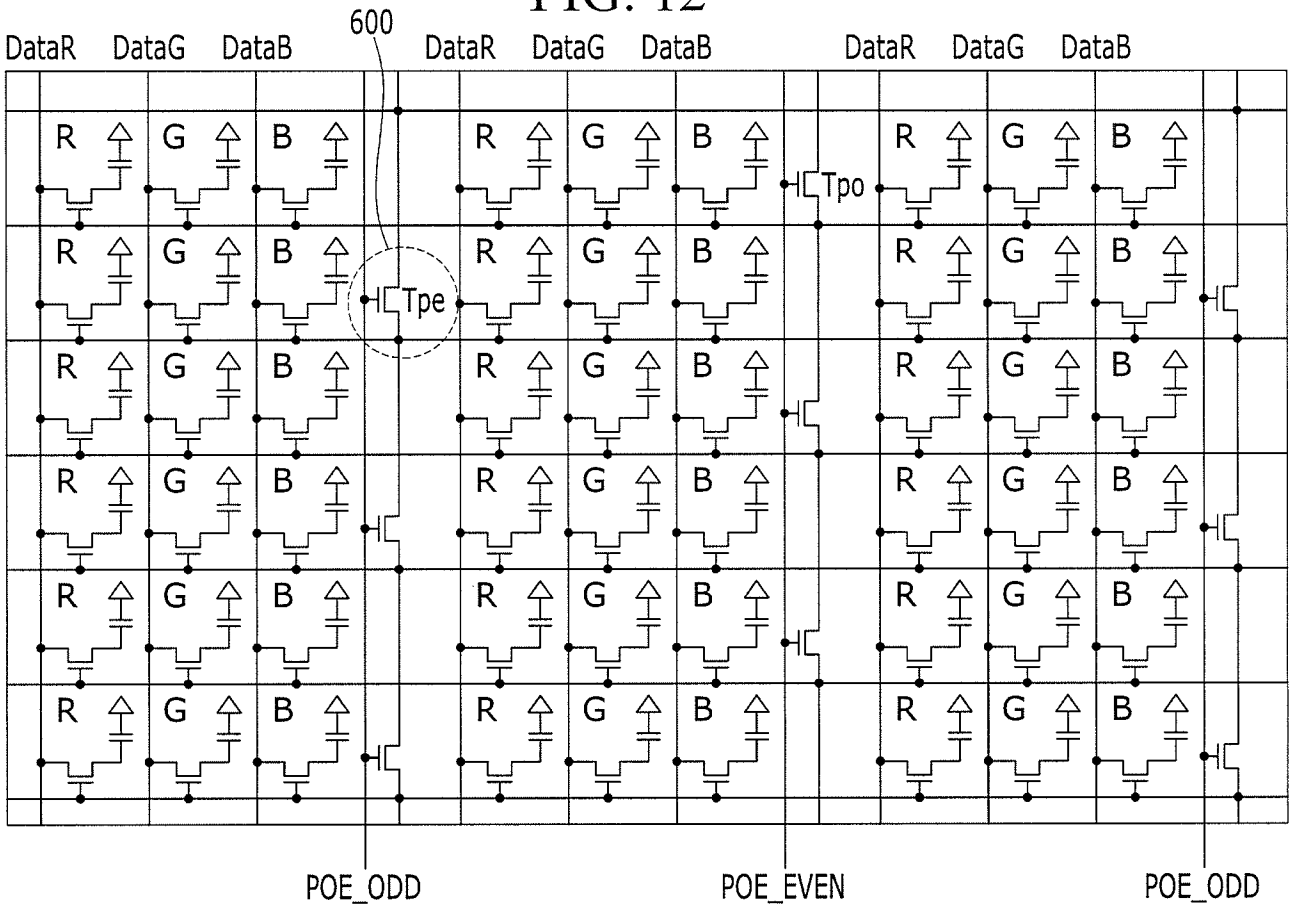

FIG. 11 and FIG. 12 illustrating examples of pixels of a display panel. In FIGS. 11 and 12, which are different from FIG. 4, one gate-off voltage applier 600 is disposed at every six pixels (two unit pixels).

As shown in FIGS. 11 and 12, similar to the embodiment of FIG. 4, each pixel includes a thin film transistor Q and a liquid crystal capacitor Clc. The thin film transistor Q of each pixel has a gate terminal connected to a gate line, a source terminal connected to a data line, and a drain terminal connected to one end of the liquid crystal capacitor Clc. A common voltage is applied to the other end of the liquid crystal capacitor Clc. Each pixel may also include an organic capacitor.

The red, green, and blue pixels arranged in a column direction constitute one unit pixel. In other words, each unit pixel includes different color pixels, or sub-pixels.

One gate-off voltage applier 600 is connected to each gate line for every two unit pixels. The gate-off voltage applier 600 applies a voltage for turning off the thin film transistor Q, and includes gate-off voltage applying transistors Tpo and Tpe. Gate terminals of the gate-off voltage applying transistors Tpo and Tpe are respectively connected to control wires POE_ODD and POE_EVEN for transferring a gate-off voltage applying signal, the gate-off voltage is applied to source terminals thereof, and drain terminals thereof are connected to the gate line.

For the signals that are respectively applied to the odd-numbered control wire and the even-numbered control wire, the signals in FIG. 5 may be used.

As shown in FIG. 11 and FIG. 12, when one gate-off voltage applier 600 is formed at every six pixels (two unit pixels), the numbers of the gate-off voltage appliers 600 and the control wires (e.g., the odd-numbered control wires and the even-numbered control wires) may be reduced, to thereby decrease the aperture ratio. Unlike in the embodiments of FIGS. 11 and 12, one gate-off voltage applier 600 may be formed at every three or more unit pixels.

Hereinafter, an embodiment including three control signals that are different from FIG. 5 will be described with reference to FIGS. 13 and 14.

Figure 13:
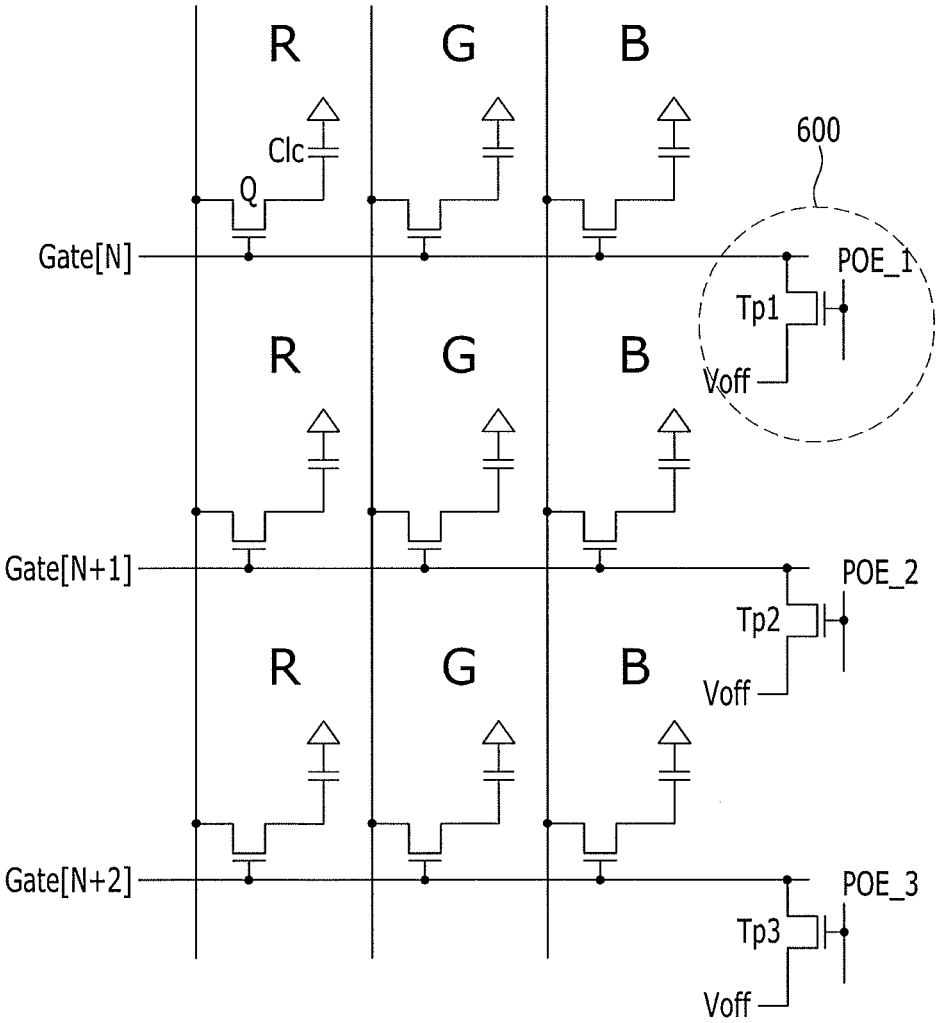
FIG. 13 illustrates another example of pixels of a display panel.
Figure 14:
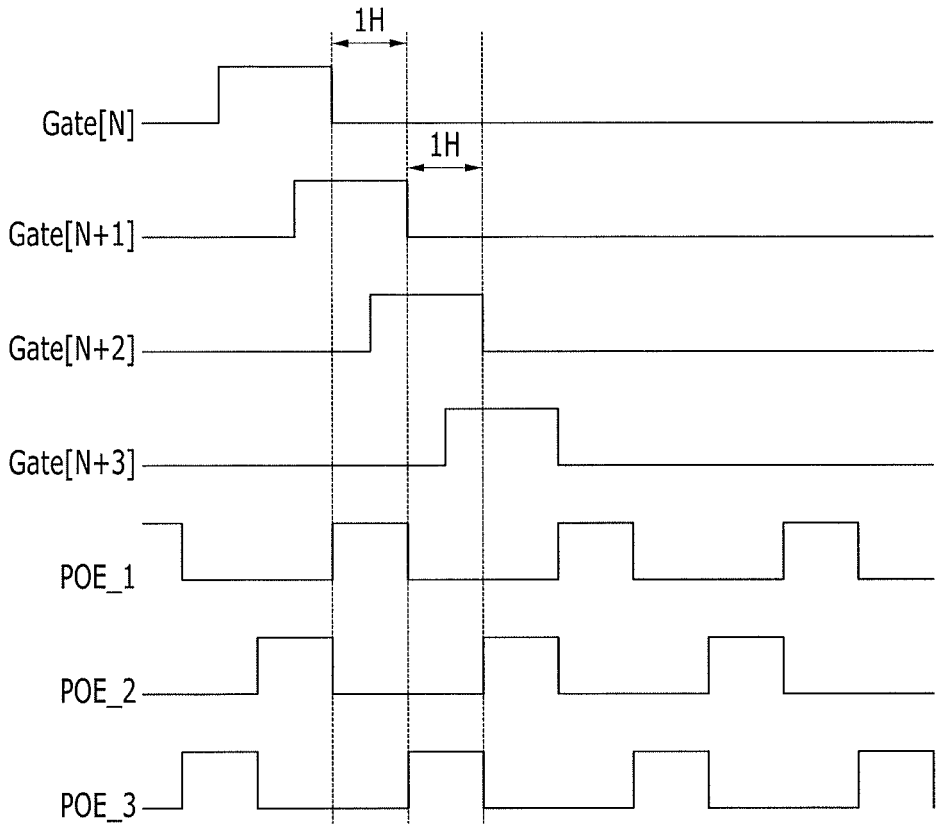
FIG. 14 illustrates an example of a signal from a display panel.

FIG. 13 illustrates examples pixels of a display panel, and FIG. 14 illustrates an example of a waveform of a signal transferred from the display panel according to the embodiment of FIG. 13. The pixels of the display panel in FIG. 13 are substantially the same as those in FIG. 4. However, the display panel includes the gate-off voltage appliers 600 that are controlled using three control signals, unlike in the embodiment of FIG. 4.

Each pixel in FIG. 13 includes a thin film transistor Q and a liquid crystal capacitor Clc. The thin film transistor Q of each pixel has a gate terminal connected to a gate line, a source terminal connected to a data line, and a drain terminal is connected to one end of the liquid crystal capacitor Clc. A common voltage is applied to the other end of the liquid crystal capacitor Clc. In another embodiment, each pixel may further include an organic capacitor.

The red, green, and blue pixels arranged in a column direction constitute one unit pixel. In other words, each unit pixel includes different color pixels, or sub-pixels.

One gate-off voltage applier 600 is connected to each gate line for every two unit pixels. In the embodiment of FIG. 13, a display panel is illustrated in which the gate-off voltage appliers 600 are controlled using a first control signal POE_1, a second control signal POE_2, and a third control signal POE_3. Herein, control wires to which the first control signal POE_1, the second control signal POE_2, and the third control signal POE_3 are respectively referred to as a first control wire, a second control wire, and a third control wire. The first to third control wires may be arranged in a direction parallel with the data line. The control signals POE_1, POE_2, and POE_3 may be referred to as gate-off voltage applying signals.

The first control signal POE_1, the second control signal POE_2, and the third control signal POE_3 are illustrated in FIG. 14. For the first control signal POE_1, a high-level voltage is applied according to the timing at which a first gate signal is converted from an on-voltage to an off-voltage, and is converted to a low-level voltage before a second gate signal is converted to the on-voltage. For the second control signal POE_2, a high-level voltage is applied according to the timing at which the second first gate signal is converted from the on-voltage to the off-voltage, and is converted to the low-level voltage before a third gate signal is converted to the on-voltage. For the third control signal POE_3, a high-level voltage is applied according to the timing at which the third first gate signal is converted from the on-voltage to the off-voltage, and is converted to the low-level voltage before a fourth gate signal is converted to the on-voltage.

The high-level voltages do not overlap each other in the first control signal POE_1, the second control signal POE_2, or the third control signal POE_3. Thus, pixels for displaying images in the display panel 100 are divided into three groups, which are respectively controlled by the first control signal POE_1, the second control signal POE_2, and the third control signal POE_3.

In the embodiment of FIG. 13, the gate-off voltage applier 600 is formed at every three pixels (one unit pixel). However, FIGS. 15 and 16 illustrate embodiments in which the gate-off voltage applier 600 is formed at every nine pixels (three unit pixels).

Figure 15:
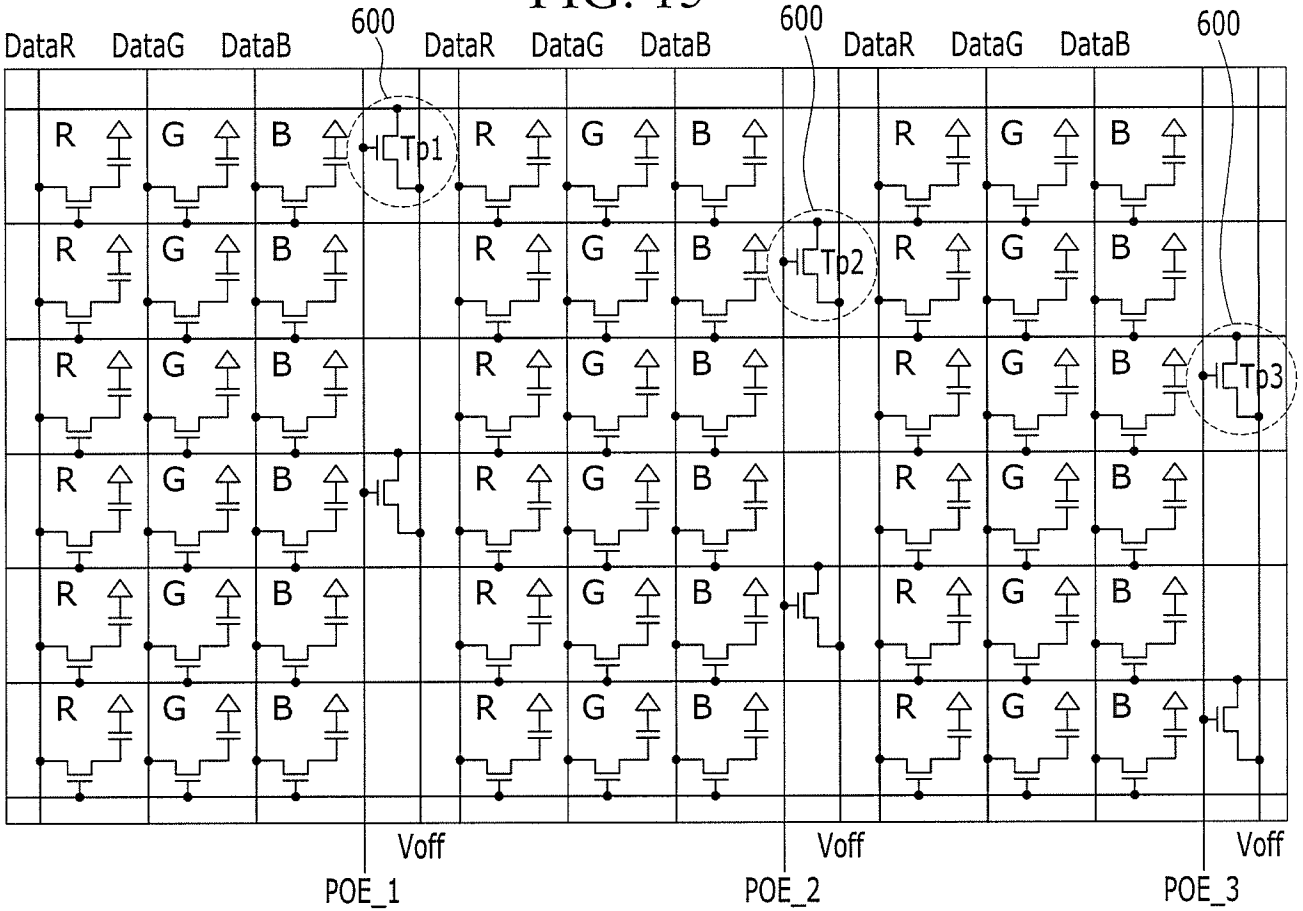
FIGS. 15 and 16 illustrate examples of pixels of a display panel.
Figure 16:
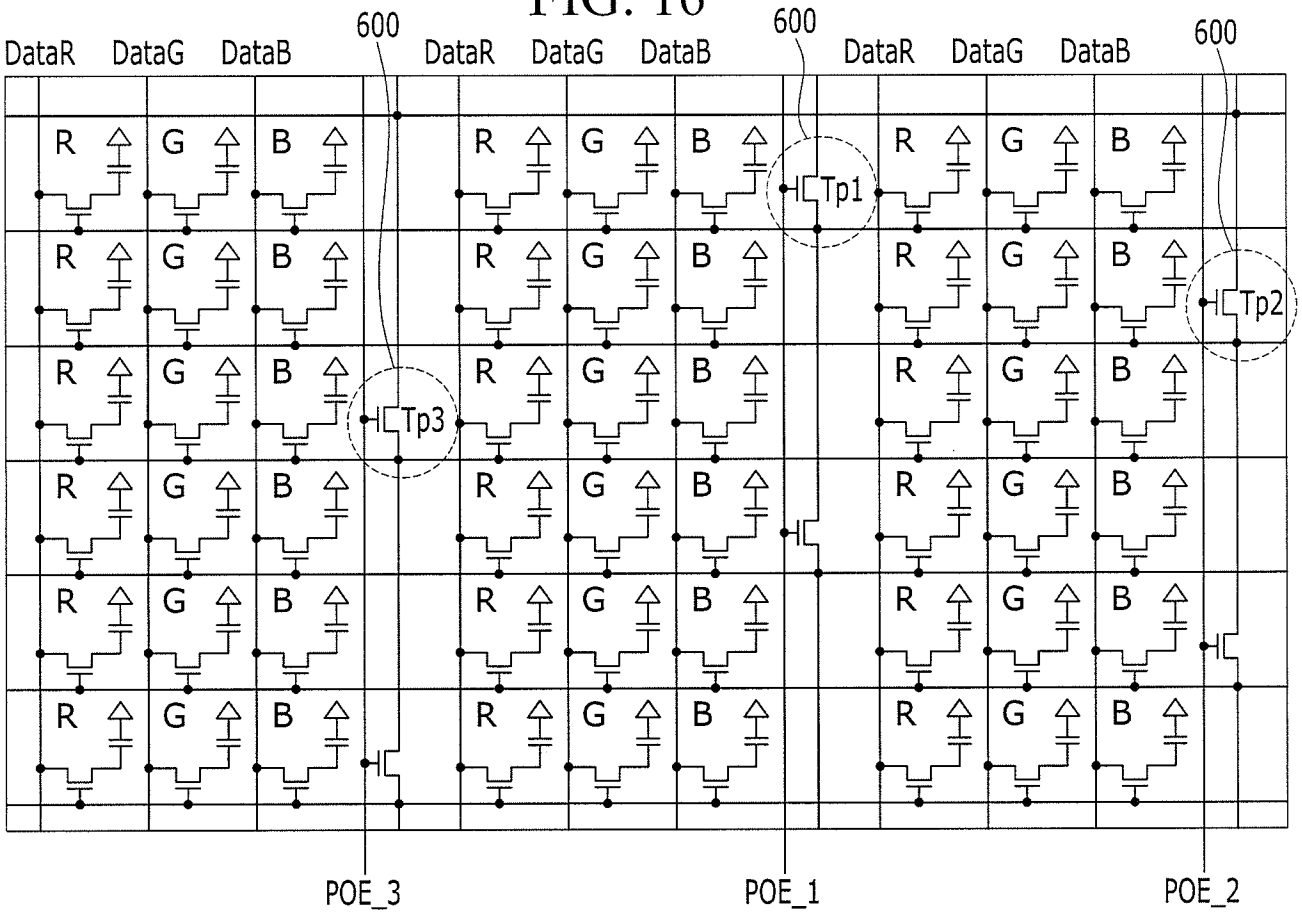

FIGS. 15 and 16 illustrate examples of pixels of a display panel. Similar to the embodiment of FIG. 13, each pixel includes a thin film transistor Q and a liquid crystal capacitor Clc. The thin film transistor Q of each pixel has a gate terminal connected to a gate line, a source terminal thereof connected to a data line, and a drain terminal connected to one end of the liquid crystal capacitor Clc. A common voltage is applied to the other end of the liquid crystal capacitor Clc. In another embodiment, each pixel may further include an organic capacitor.

The red, green, and blue pixels arranged in a column direction constitute one unit pixel. In other words, each unit pixel includes different color pixels, or sub-pixels.

One gate-off voltage applier 600 may be connected to each gate line for every three unit pixels. The gate-off voltage applier 600 applies a voltage for turning off the thin film transistor Q, and includes gate-off voltage applying transistors Tp1, Tp2, and Tp3. Gate terminals of the gate-off voltage applying transistors Tp1, Tp2, and Tp3 are respectively connected to first to third control wires, for transferring a gate-off voltage applying signal. The gate-off voltage is applied to source terminals thereof, and drain terminals thereof are connected to the gate line.

For the first to third control signals POE_1, POE_2, and POE_3 that are respectively applied to the first to third control wires, the signals in FIG. 14 may be used.

As shown in FIGS. 15 and 16, when one gate-off voltage applier 600 is formed at every nine pixels (three unit pixels), the numbers of the gate-off voltage appliers 600 and the control wires may be reduced, to thereby decrease the aperture ratio. One gate-off voltage applier 600 may be formed at every four or more unit pixels.

Hereinafter, an embodiment including the gate-off voltage applier 600 having a different structure will be described with reference to FIGS. 17 and 18.

Figure 17:
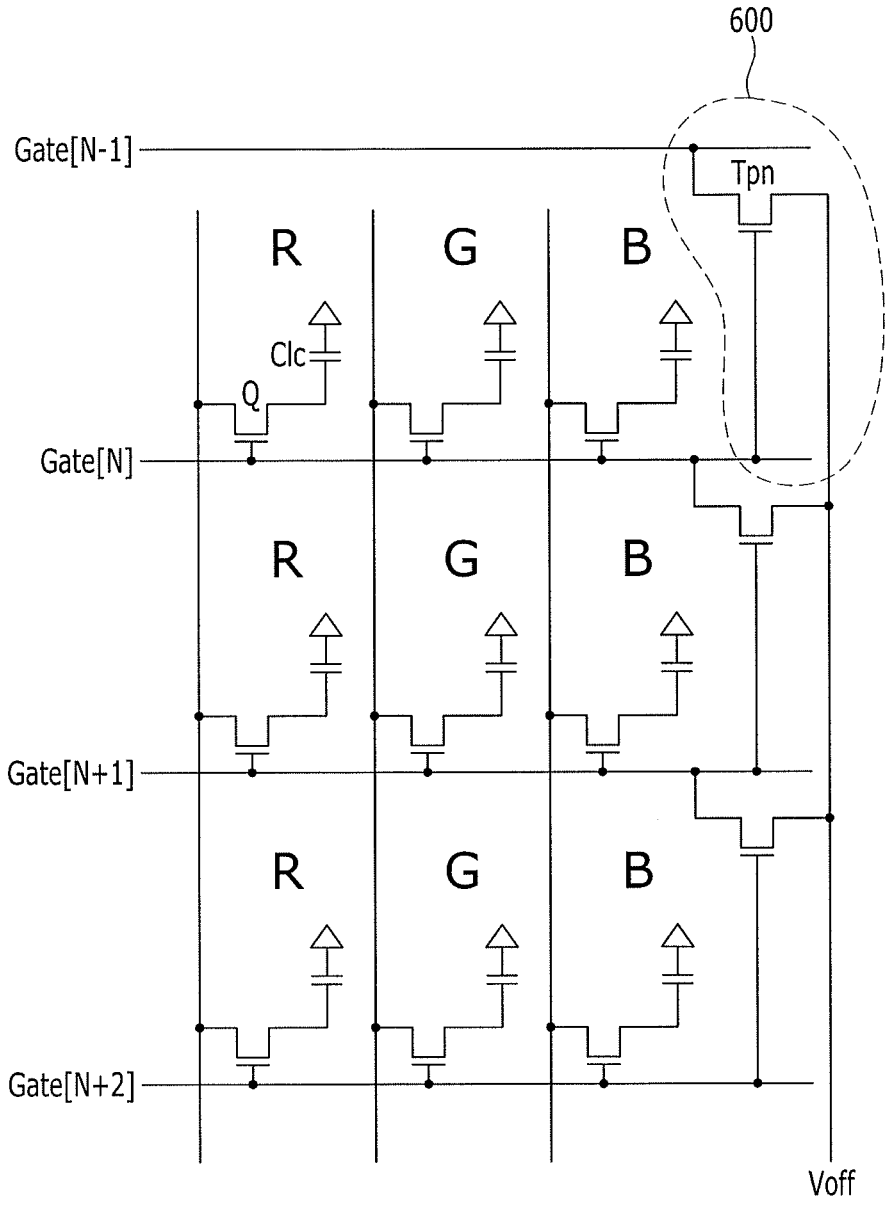
FIG. 17 illustrates examples of pixels of a display panel.
Figure 18:
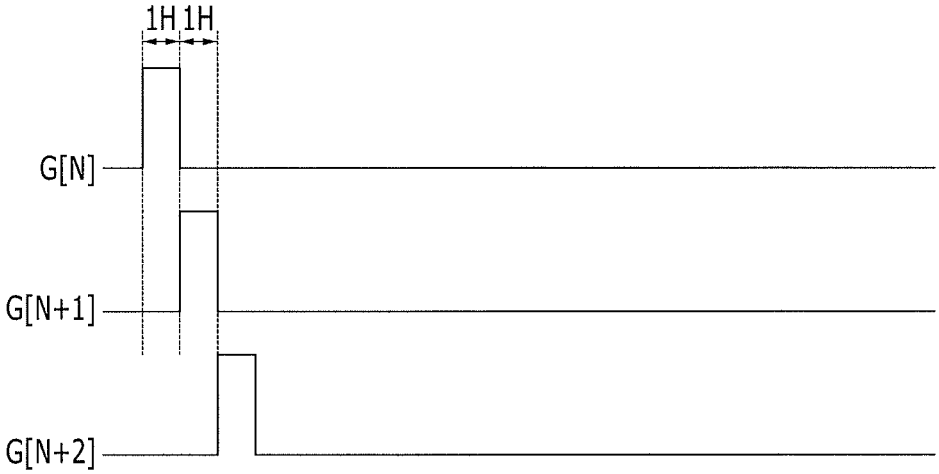
FIG. 18 illustrates an example of a signal from a display panel.

FIG. 17 illustrates examples of pixels of a display panel, and FIG. 18 illustrates a waveform of a signal transferred from the display panel of FIG. 17. The pixels of the display panel in FIG. 17 are substantially the same as those in FIG. 4. However, unlike in the embodiment of FIG. 4, a gate-off voltage applying transistor Tpn in each gate-off voltage applier 600 has a different connection structure. For example, in the embodiment of FIG. 17, the gate-off voltage applier 600 includes the gate-off voltage applying transistor Tpn. In this case, the gate-off voltage applying transistor Tpn has a gate terminal connected to a gate line of a next stage, a source terminal which recites the gate-off voltage, and a drain terminal connected to a gate line of the present stage. The gate-off voltage applying transistor Tpn of FIG. 17 converts a gate signal of the gate line of the present stage to a gate-off voltage according to a gate-on voltage applied to the gate line of a next stage.

Referring to FIG. 18, the gate-on voltage that is applied to the gate line of the present stage does not overlap the gate-on voltage applied to the gate line of the next stage. Thus, the control signal for controlling the gate-off voltage applier 600 may be used as the gate signal of the next stage.

An embodiment including the gate-off voltage applier 600 having a different structure will be described with reference to FIGS. 19 and 20.

Figure 19:
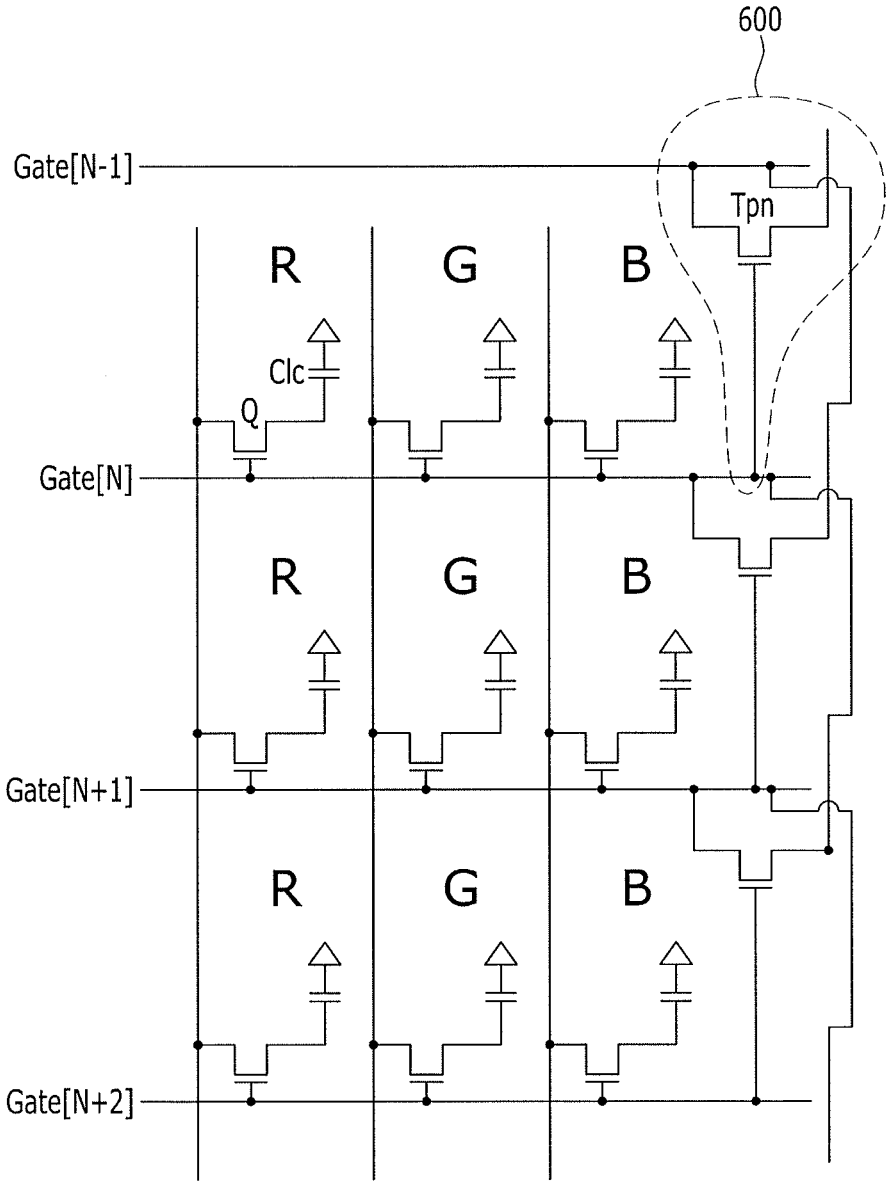
FIG. 19 illustrates examples of pixels of a display panel.
Figure 20:
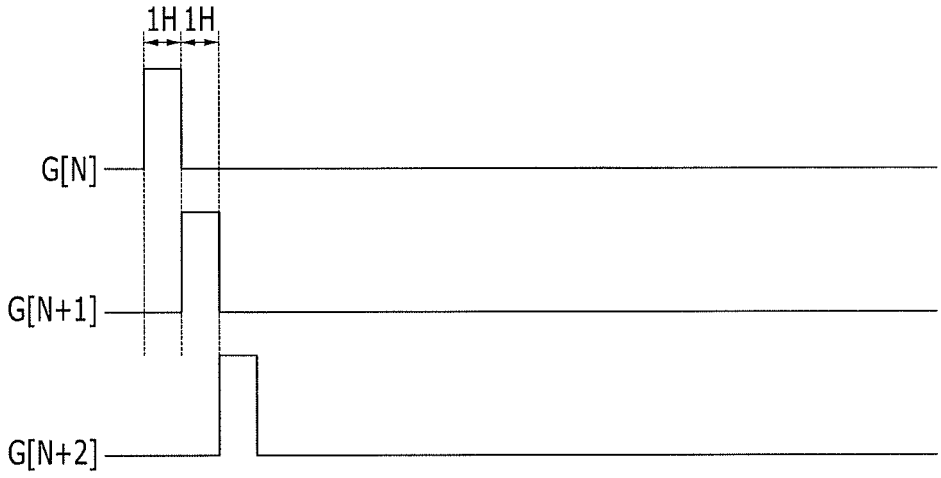
FIG. 20 illustrates an example of a signal from the display panel.

FIG. 19 illustrates examples of pixels of a display panel and FIG. 20 illustrates a waveform of a signal transferred from the display panel of FIG. 17. The pixels of the display panel in FIG. 19 are substantially the same as those in FIG. 17. However, a gate-off voltage applying transistor Tpn in each gate-off voltage applier 600 has a different connection structure. For example, in FIG. 19, the gate-off voltage applier 600 includes the gate-off voltage applying transistor Tpn. In this case, a gate terminal of the gate-off voltage applying transistor Tpn is connected to a gate line of a next stage, a source terminal thereof is connected to a gate line of a previous stage, and a drain terminal thereof is connected to a gate line of the present stage.

According to the embodiment of FIG. 19, the gate-off voltage applying transistor Tpn serves to convert a gate signal of the gate line of the present stage to a gate signal of the previous stage according to a gate-on voltage applied to the gate line of a next stage. However, as shown in FIG. 20, when the gate-on voltage is applied to the gate line of the next stage, the gate signal of the previous stage is the gate-off voltage. Accordingly, the gate signal of the present stage is converted to the gate-off voltage.

Referring to FIG. 20, the gate-on voltage applied to the gate line of the present stage, the gate-on voltage applied to the gate line of the next stage, and the gate-on voltage applied to the gate line of the previous stage do not overlap each other. Thus, the control signal for controlling the gate-off voltage applier 600 and a voltage of the source terminal that is applied to the gate-off voltage applier 600 may be used as the gate signal of the next stage and the gate signal of the previous stage.

An embodiment including the gate-off voltage applier 600 having a different structure will be described with reference to FIG. 21 and FIG. 22.

Figure 21:
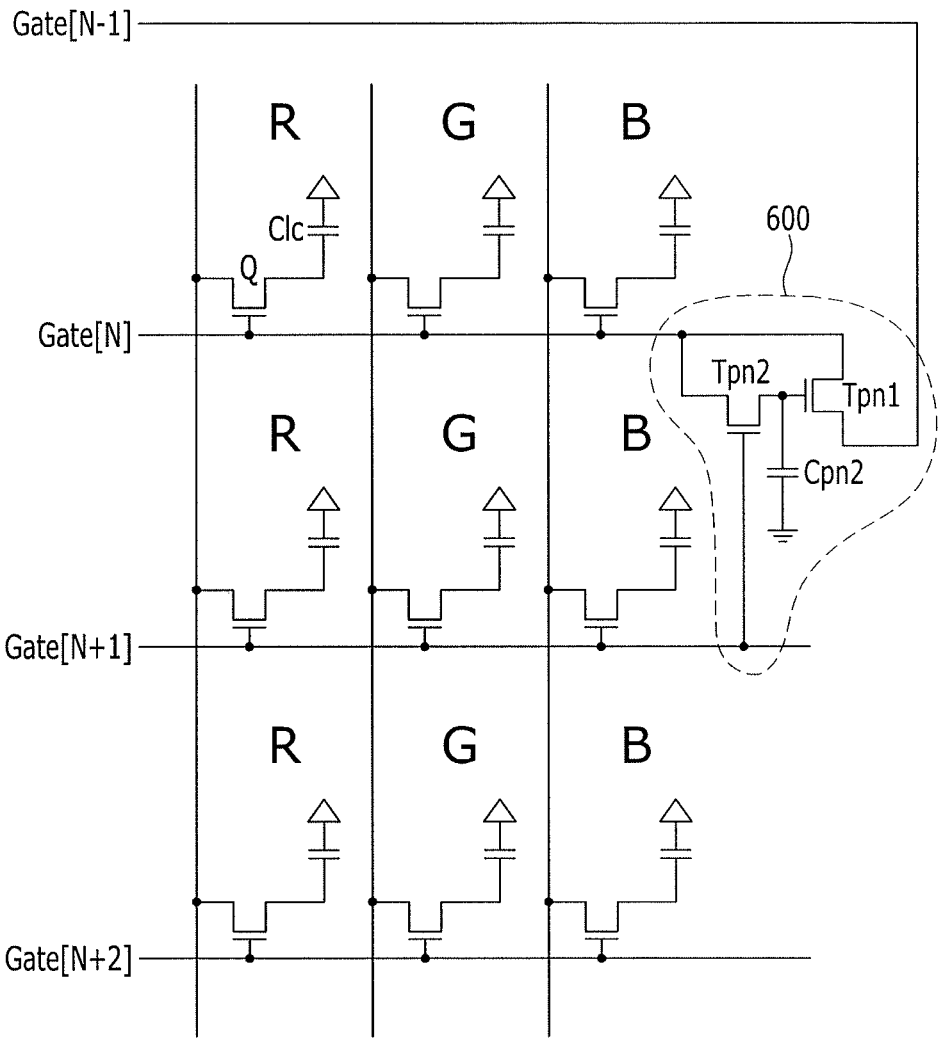
FIG. 21 illustrates examples of pixels of a display panel.
Figure 22:
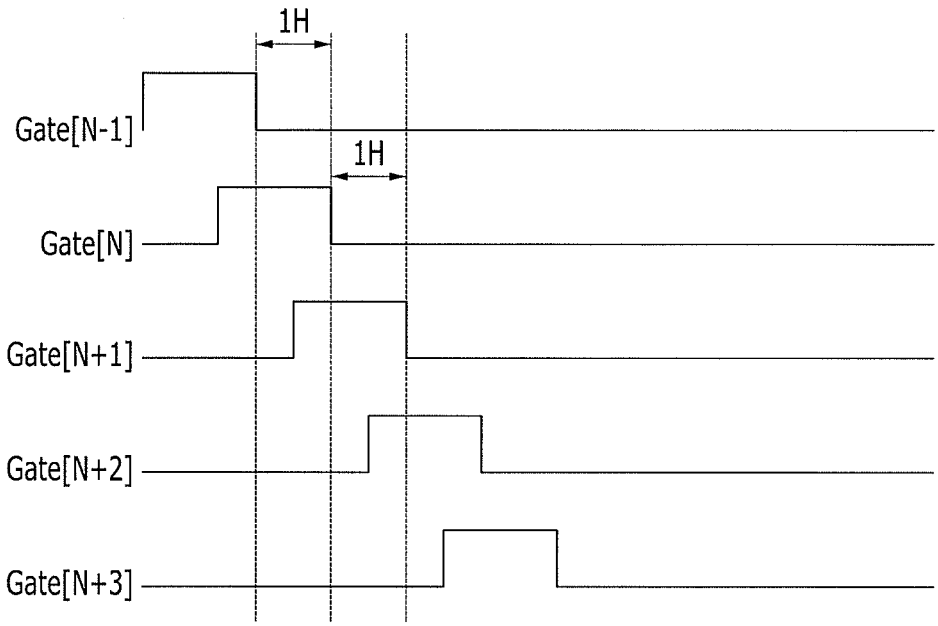
FIG. 22 illustrates an example of a signal from a display panel.

FIG. 21 illustrates examples of pixels of a display panel, and FIG. 22 illustrates a waveform of a signal transferred from the display panel of FIG. 21. The pixels of the display panel in FIG. 21 are substantially the same as those in FIG. 17. However, unlike in the embodiment of FIG. 17, the gate-off voltage applier 600 has a different structure.

The gate-off voltage applier 600 used in the embodiment of FIG. 21 includes two transistors and one capacitor. Specifically, the gate-off voltage applier 600 of FIG. 21 includes a first gate-off voltage applying transistor Tpn1, a second gate-off voltage applying transistor Tpn2, and a capacitor Cpn2.

A gate line of the present stage is connected to the source terminal of the first gate-off voltage applying transistor Tpn1 of the gate-off voltage applier 600, and a gate terminal thereof is connected to a first node. Further, the gate line of the present stage is connected to a source terminal of the second gate-off voltage applying transistor Tpn2, the first node is connected to a drain terminal thereof, and a gate terminal thereof is connected to a gate line of a next stage. The capacitor Cpn2 is formed between a ground terminal and the first node.

The gate signals with the same timing as that of the signals in FIG. 22 may be applied to the gate-off voltage applier 600 having the aforementioned structure. The gate signal in FIG. 22 has a structure in which the gate-on voltage of a gate signal of a previous stage overlaps that of a gate signal of the present stage. Further, one gate-on voltage has a section longer than the period 1H.

When the same gate signal as in FIG. 22 is used, the gate-off voltage applier 600 performs the following operations. First, when the gate-on voltage is applied to a gate line of a previous stage, the gate-off voltage applier 600 connected to the gate line of the present stage performs no specific operation. Next, the gate-on voltage is applied to the gate line of the present stage, while the gate-on voltage is applied to the gate line of the previous gate line. However, the gate-off voltage applier 600 of the present stage still performs no specific operation.

Next, the signal converted to the gate-off voltage is applied to the gate line of the previous stage, and the gate-on voltage is still applied to the gate line of the present stage. Similarly, the gate-off voltage applier 600 of the present stage still performs no specific operation.

Next, the gate-on voltage is applied to the gate line of the next stage, while the gate-on voltage is applied to the gate line of the present stage. At this time, in the gate-off voltage applier 600 of the present stage, the second gate-off voltage applying transistor Tpn2 is turned on and the gate-on voltage of the present stage is accumulated in the capacitor Cpn2. The voltage accumulated in the capacitor Cpn2 becomes a voltage of the first node. While the gate-on voltage is accumulated in the capacitor Cpn2, the first gate-off voltage applying transistor Tpn1 is turned on. Once the first gate-off voltage applying transistor Tpn1 is turned on, the gate line of the previous stage communicates with the gate line of the present stage. As a result, the voltage of the present stage is converted to a low-level voltage.

The timing at which the voltage of the gate line of the present stage is converted to the low-level voltage may be changed by the voltage accumulated in the capacitor Cpn2 and a threshold voltage of the first gate-off voltage applying transistor Tpn1. In this way, it is possible to adjust the timing at which the voltage of the gate line of the present stage is converted to the low-level voltage.

Figure 23:
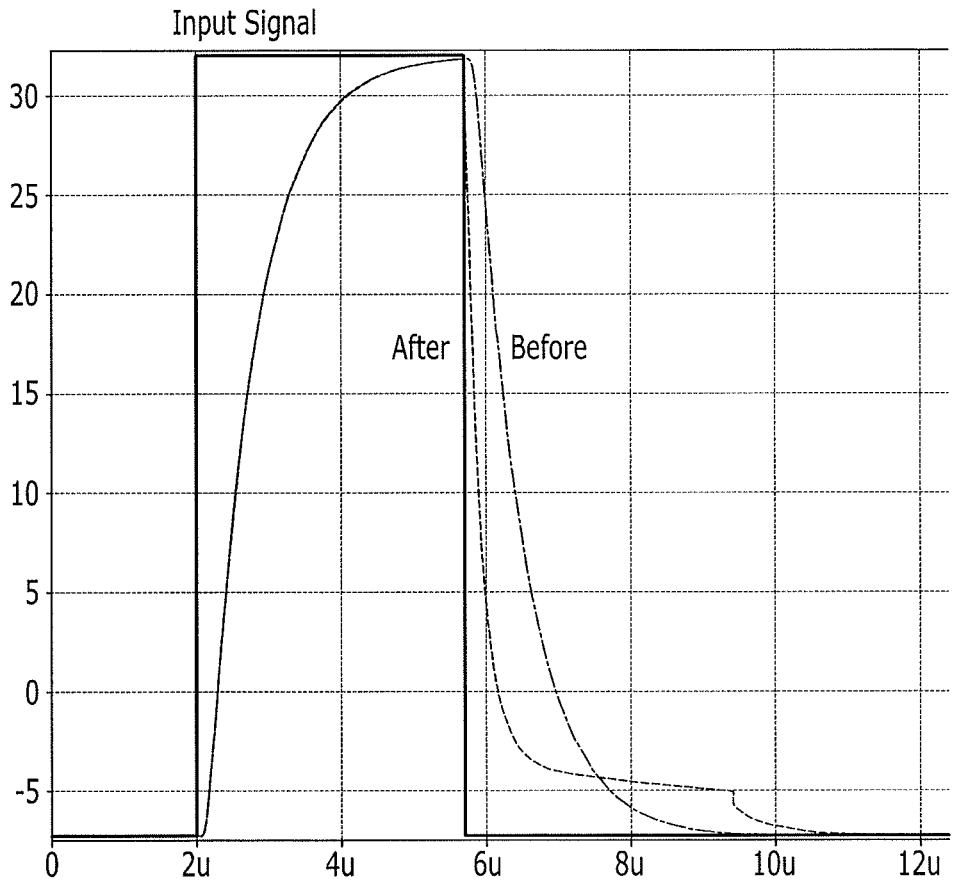
FIG. 23 illustrates examples of a gate signal in a display panel.

FIG. 23 illustrates variations of the gate voltage according to the embodiment of FIGS. 21 and 22. FIG. 23 illustrates an example of a waveform of a gate signal in a display panel according to the embodiments of FIGS. 21 and 22. In FIG. 23, "before" corresponds to the case where the gate-off voltage applier 600 performs no operation. The term "after" indicates the case that the gate-off voltage applier 600 performs a specific operation.

From the graph in FIG. 23, it is determined that the speed at which the signal is converted to the gate-off voltage becomes much faster by action of the gate-off voltage applier 600. However, in the case that the gate-off voltage applier 600 performs a specific operation, it is determined that the speed at which the signal is converted to the gate-off voltage is reduced from a specific voltage level (e.g., about −3 V). Then, the signal is rapidly converted to the gate-off voltage according to the timing at which the gate-off voltage is applied to the gate line of the next stage.

As such, by action of the gate-off voltage applier 600, the signal is converted to a voltage close to the gate-off voltage at a quick speed, thereby removing the problem caused by the delayed application of the gate-on voltage.

An embodiment in which the gate-off voltage is applied using a gate signal of a next stage will be described in more detail with reference to FIGS. 24 and 25.

Figure 24:
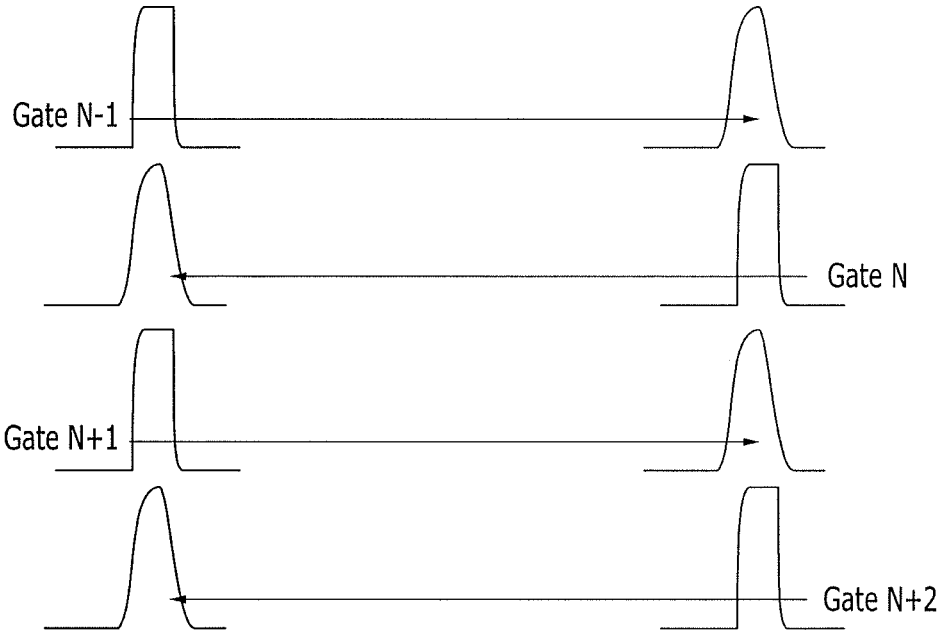
FIG. 24 illustrates examples of gate signals from a display panel.
Figure 25:
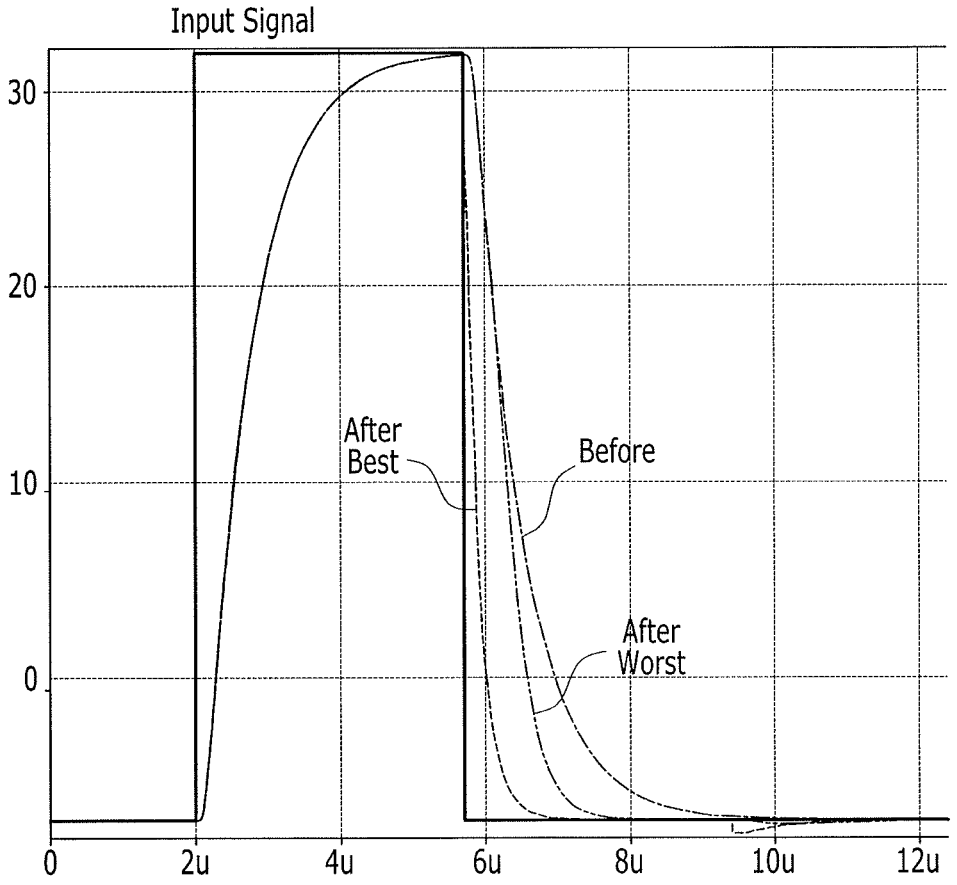
FIG. 25 illustrates examples of gate signals from a display panel.

FIG. 24 illustrates a waveform of gate signals transferred from a display panel, and FIG. 25 illustrates a waveform of gate signals transferred from the display panel. In the case of a large-size display device, gate drivers may be respectively disposed at left and right sides of a display panel thereof to alternately apply the gate-on voltage. In this case, a gate voltage of a previous stage is applied from the gate driver disposed at the left side thereof, but a gate voltage of a next stage is applied from the gate driver disposed at the right side thereof. These waveforms are illustrated in FIG. 24.

Referring to FIG. 24, for $(N-1)^{th}$ and $(N+1)^{th}$ gate lines, the gate voltage is applied from the gate driver at the left side. Thus, the gate voltage that is not delayed is applied to pixels at the left side of the display panel. However, the delayed gate voltage is applied to pixels at the right side of the display panel. For $N^{th}$ and $(N+2)^{th}$ gate lines, the gate voltage is applied from the gate driver at the right side. Thus, the gate voltage that is not delayed is applied to pixels at the right side of the display panel. However, the delayed gate voltage is applied to pixels at the left side of the display panel In FIG. 25, the term "before" indicates the case that the gate-off voltage applier 600 performs no operation. The term "after best" indicates the gate voltage that is not delayed, because the corresponding pixels are located close to the gate driver that applies the gate voltage in the display panel. The term "after worst" indicates the gate voltage that is worse delayed, because the corresponding pixels are located far away from the gate driver that applies the gate voltage in the display panel.

In this structure, when the gate-off voltage applier 600 is operated based on the gate voltage of the gate line of the next stage, the timing at which the signal is converted to the gate-off voltage may be delayed due to the delay of the gate signal. However, both of the non-delayed gate voltage and the worst delayed gate voltage are connected to the gate-off voltage applier 600 to actually interact with each other, thereby obtaining a generally uniform gate voltage.

The case where the gate-on voltage and the gate-off voltage are respectively the high-level voltage and the low-level voltage has been described based on the liquid crystal display. Hereinafter, the case where the gate-on voltage and the gate-off voltage are respectively a low-level voltage and a high-level voltage will be described based on an organic light emitting diode display, using a polysilicon semiconductor, with reference to FIGS. 26 to 31. First, an embodiment of FIGS. 26 and 27 will be described.

Figure 26:
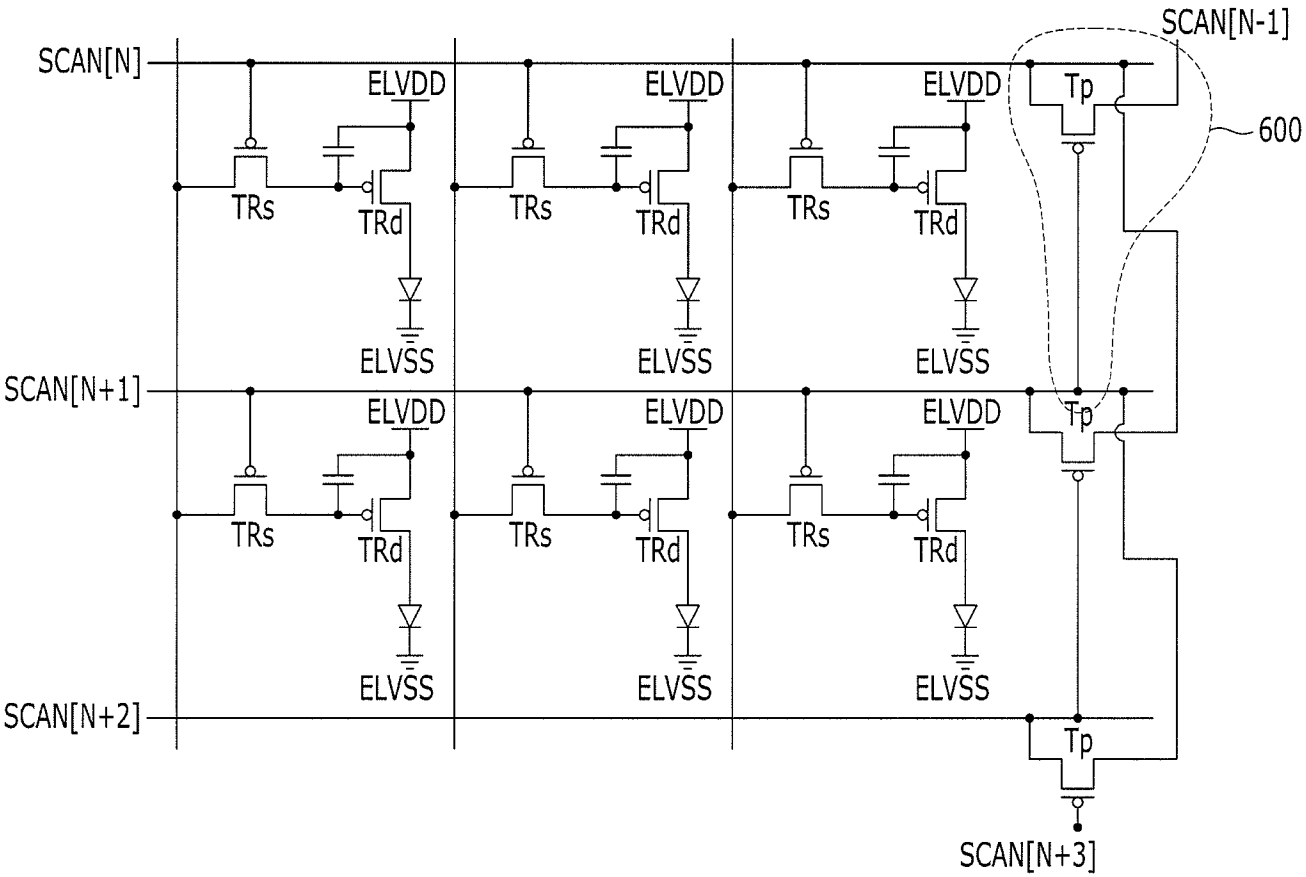
FIG. 26 illustrates examples of pixels of a display panel.
Figure 27:
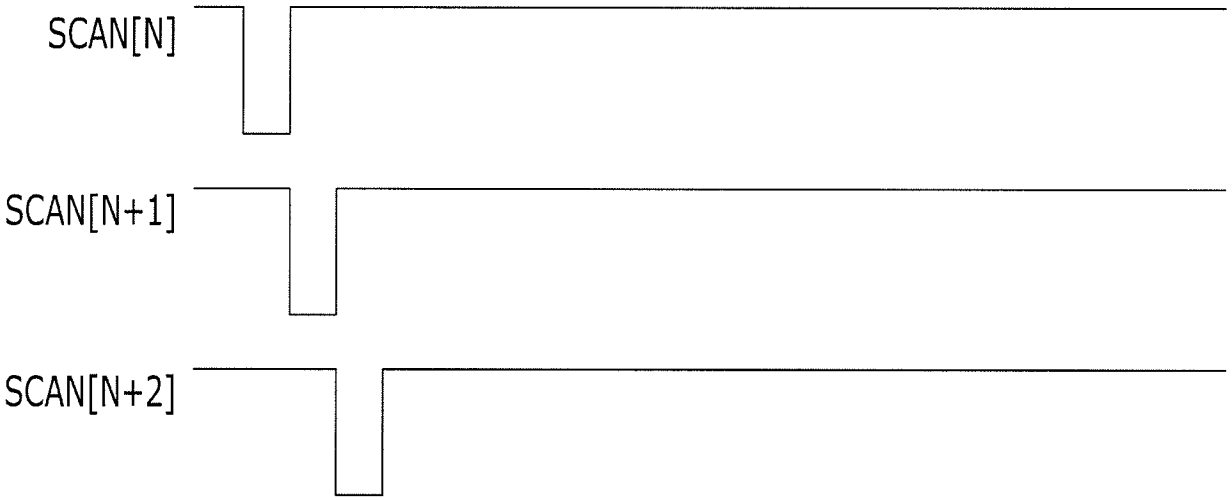
FIG. 27 illustrates an example of a signal from a display panel.

FIG. 23 illustrates an example of a waveform of a gate signal in a display panel of FIGS. 21 and 22, and FIG. 27 is a waveform diagram of a signal transferred from the display panel according to the embodiment of FIG. 26.

The circuit diagram of FIG. 26 is of an organic light emitting diode panel. The organic light emitting diode panel in FIG. 26 includes a plurality of pixels arranged in a matrix of rows and columns. Each pixel includes a switching transistor TRs, a driving transistor TRd, and a light emitting diode (LED). A gate terminal of the switching transistor TRs is connected to a gate line, and a source terminal thereof is connected to a data line. A drain terminal of the switching transistor TRs is connected to a gate terminal of the driving transistor TRd. A source terminal of the driving transistor TRd is connected to a power source voltage ELVDD, and a drain terminal thereof is connected to one terminal of the organic light emitting diode. A capacitor may be between the gate terminal and the source terminal of the driving transistor TRd. A low-level voltage ELVSS is connected to the other terminal of the organic light emitting diode.

FIG. 26 illustrates a pixel structure of a organic light emitting diode panel. The pixels may have various circuit structures. In FIG. 26, one gate-off voltage applier 600 is connected to each gate line per unit pixel. The gate-off voltage applier 600 applies a voltage for turning off the switching transistor TRs, and includes a gate-off voltage applying transistor Tp. The gate-off voltage applying transistor Tp has a gate terminal connected to a gate line of a next stage, a source terminal connected to a gate line of a previous stage, and a drain terminal connected to a gate line of the present stage.

In the present embodiment, the gate-off voltage applier 600 is formed per unit pixel. Two or more of gate-off voltage appliers 600 are connected to one gate line in an alternative embodiment.

FIG. 27 illustrates gate signals applied to each gate line. Referring to FIG. 27, gate-on voltages (e.g., low-level voltages) are sequentially applied to the respective gate lines. Gate-off voltages (e.g., high-level voltages) are applied in sections in which no gate-on voltages (e.g., low-level voltages) are applied. In the embodiment of FIGS. 26 and 27, the transistor using a polysilicon semiconductor is employed, and the gate-on voltage is the low-level voltage. In the present embodiment, the gate-on voltages that are applied to the respective gate lines do not overlap each other.

The structure of FIG. 26 will be described based on the signals of FIG. 27. Once the gate-on voltage (low-level voltage) is applied to the gate line of a present stage, the switching transistor TRs of a pixel is turned on to transfer the data voltage, that is applied to the data line, to the gate terminal of the driving transistor TRd. The transferred voltage is accumulated in the capacitor. The amount of a current output from the driving transistor TRd is determined according to the accumulated voltage of the capacitor. The current output from the driving transistor TRd is transferred to the light emitting diode to emit light. The luminance of light emitted from the light emitting diode is also determined according to the magnitude of the current from the driving transistor TRd.

Once the gate-off voltage (high-level voltage) is applied to the gate line of the present stage and the gate-on voltage (low-level voltage) is applied to the gate line of the next stage, the gate-off voltage applying transistor Tp of the gate-off voltage applier 600 connected to the gate line of the present stage is turned on by the gate-on voltage (low-level voltage) of the next stage. In this case, the gate-off voltage (high-level voltage) is applied to the gate line of the previous stage. Thus, the gate-off voltage (high-level voltage) applied to the gate line of the previous stage is applied to the gate line of the present stage. As a result, at the gate line of the present stage, the delay generated while the signal is converted from the gate-on voltage (low-level voltage) to the gate-off voltage (high-level voltage) is reduced as the gate-off voltage (high-level voltage) of the previous stage is additionally applied. Thus, the signal is rapidly converted into the gate-off voltage (high-level voltage).

Accordingly, by action of the gate-off voltage appliers 600, none of the pixels encounter any problem caused by the delay. This is because the gate-off voltage (high-level voltage) is quickly maintained after the gate-on voltage is applied.

Figure 28:
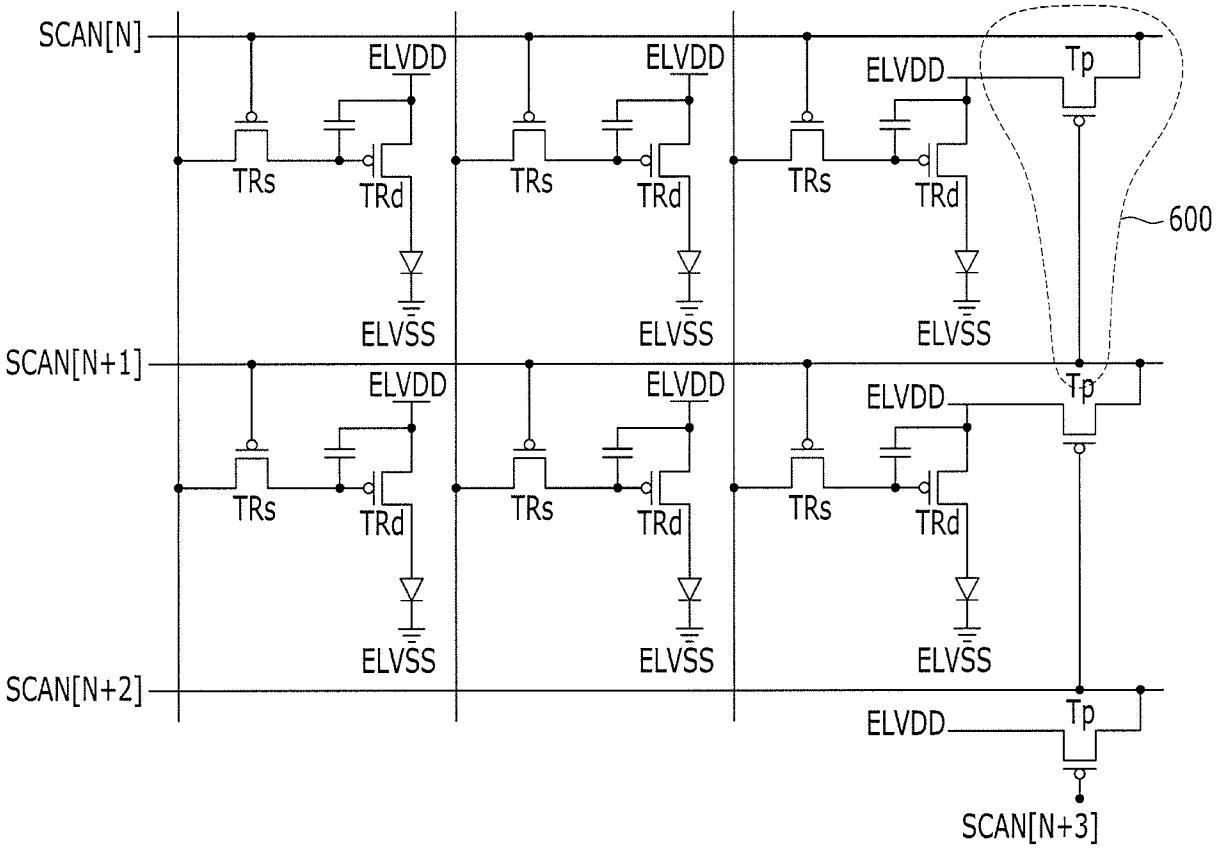
FIG. 28 illustrates examples of pixels of a display panel.
Figure 29:
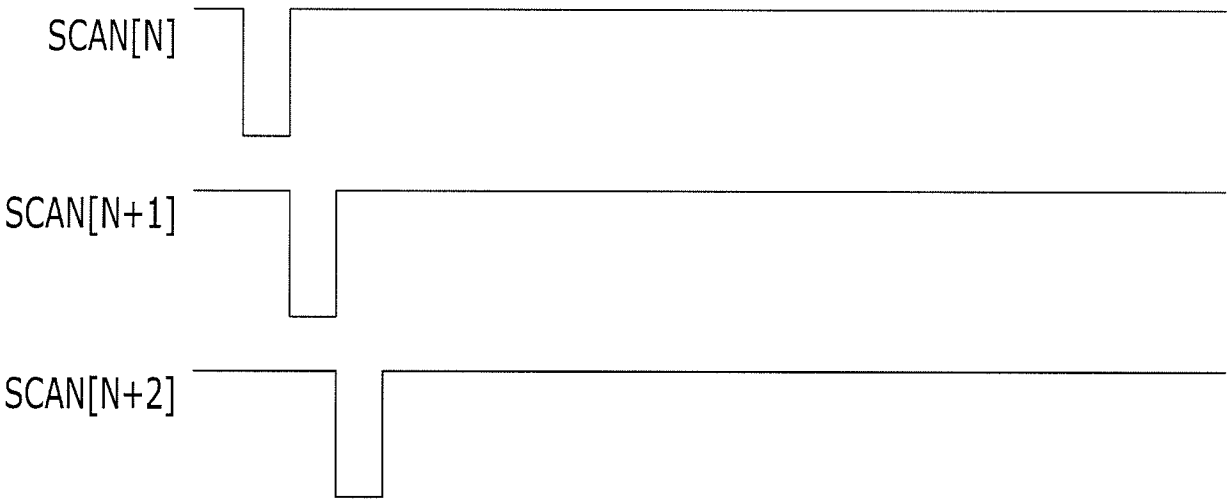
FIGS. 29 and 30 illustrate examples of a signal from the display panel.
Figure 30:
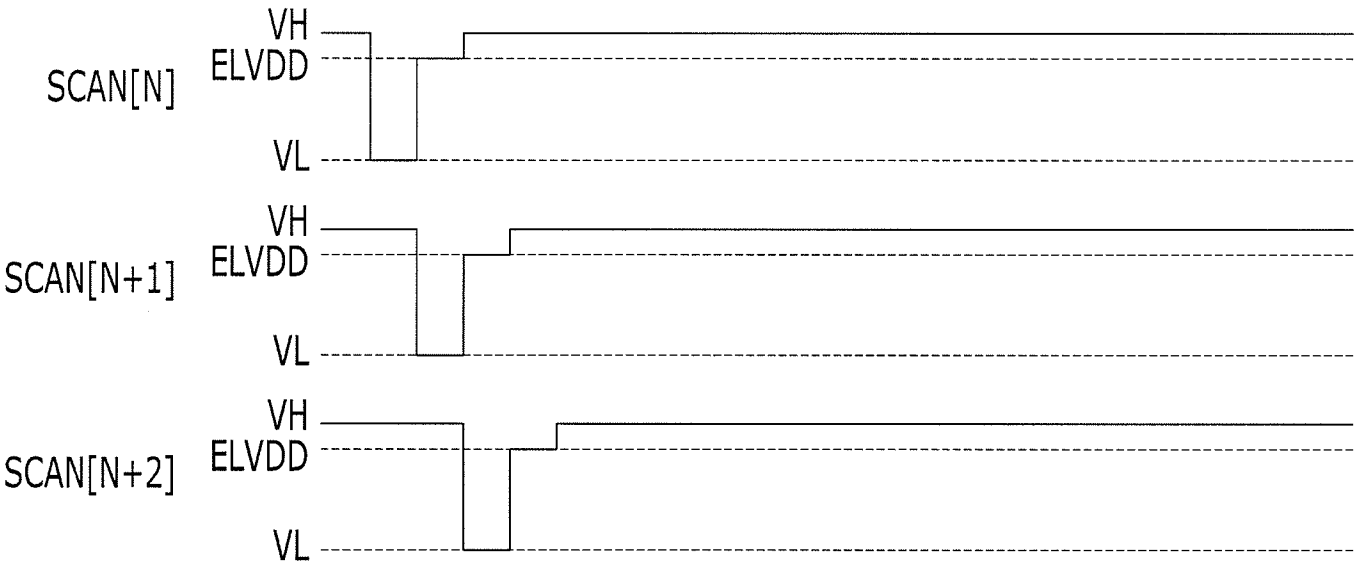

FIGS. 28 to 30 illustrate other embodiments for a display device. FIG. 28 illustrates pixels of a display panel, and FIGS. 29 and 30 are waveform diagrams of a signal transferred from the display panel according to the embodiment of FIG. 28. The circuit diagram of FIG. 28 is of an organic light emitting diode panel.

Unlike in the embodiment of FIG. 26, the source terminal of the gate-off voltage applying transistor Tp is connected to the power source voltage ELVDD in the embodiment of FIG. 28. Hereinafter, the structure of FIG. 28 will be described.

The organic light emitting diode panel in FIG. 26 includes a plurality of pixels arranged in a matrix of rows and columns. Each pixel includes a switching transistor TRs, a driving transistor TRd, and a light emitting diode (LED). The switching transistor TRs has a gate terminal connected to a gate line, a source terminal connected to a data line, and a drain terminal connected to a gate terminal of the driving transistor TRd. The source terminal of the driving transistor TRd is connected to the power source voltage ELVDD, and the drain terminal of the driving transistor TRd is connected to one terminal of the organic light emitting diode. A capacitor may be formed between the gate terminal and the source terminal of the driving transistor TRd. A low-level voltage ELVSS is connected to the other terminal of the organic light emitting diode.

In FIG. 28, the pixel structure of a organic light emitting diode panel is illustrated, and the pixels may have various circuit structures. In the embodiment of FIG. 28, one gate-off voltage applier 600 is connected to each gate line per unit pixel. The gate-off voltage applier 600 applies a voltage for turning off the switching transistor TRs, and includes a gate-off voltage applying transistor Tp. The gate-off voltage applying transistor Tp has a gate terminal connected to a gate line of a next stage, a source terminal connected to a gate line of a previous stage, and a drain terminal connected to a gate line of the present stage.

In the present embodiment, the gate-off voltage applier 600 is formed per unit pixel. However, two or more of gate-off voltage appliers 600 may be connected to one gate line in an another embodiment.

FIG. 29 illustrates gate signals applied to each gate line. Referring to FIG. 29, gate-on voltages (low-level voltages) are sequentially applied to the respective gate lines, and gate-off voltages (high-level voltages) are applied in sections in which no gate-on voltages (low-level voltages) are applied. In the embodiments of FIGS. 28 and 29, the transistor uses a polysilicon semiconductor, and the gate-on voltage is the low-level voltage. In the present embodiment, the gate-on voltages that are applied to the respective gate lines do not overlap each other.

The structure of FIG. 28 will be described based on the signals of FIG. 27. Once the gate-on voltage (low-level voltage) is applied to the gate line of the present stage, the switching transistor TRs of a pixel is turned on to transfer the data voltage, that is applied to the data line, to the gate terminal of the driving transistor TRd. The transferred voltage is accumulated in the capacitor. The amount of current output from the driving transistor TRd is determined according to the accumulated voltage of the capacitor. The current output from the driving transistor TRd is transferred to the light emitting diode to emit light. The luminance of light emitted from the light emitting diode is also determined according to the magnitude of the current output from the driving transistor TRd.

Once the gate-off voltage (high-level voltage) is applied to the gate line of the present stage and the gate-on voltage (low-level voltage) is applied to the gate line of the next stage, the gate-off voltage applying transistor Tp of the gate-off voltage applier 600 connected to the gate line of the present stage is turned on by the gate-on voltage (low-level voltage) of the next stage. As a result, the power source voltage ELVDD is applied to the gate line of the present stage.

Because the power source voltage ELVDD is set to the high-level voltage, the power source voltage ELVDD is employed instead of the gate-off voltage in the present embodiment. However, the gate-off voltage (high-level voltage) and the power source voltage ELVDD may have different values. Referring to FIG. 30, in the present embodiment, the gate-off voltage (high-level voltage) has a value higher than the power source voltage ELVDD.

As a result, at the gate line of the present stage, a two-step operation is performed: the gate voltage is firstly increased by the power source voltage ELVDD applied through the gate-off voltage applying transistor Tp, and is secondly increased by the gate-off voltage (see FIG. 30). Although this two-step operation is performed, a problem may be caused by the delay of the gate voltage. This is because the voltage level is rapidly increased by the power source voltage ELVDD.

Except for the case of FIG. 30, the gate-off voltage applier 600 applies the same voltage as the gate-off voltage. However, in one embodiment, a voltage close to the gate-off voltage is applied. In this case, the "gate-off voltage applier" may be referred to as a "voltage applier."

In the meantime, the voltage difference between the power source voltage ELVDD and the gate-off voltage may be varied. This is also true in an embodiment in which the power source voltage ELVDD is higher than the gate-off voltage.

Figure 31:
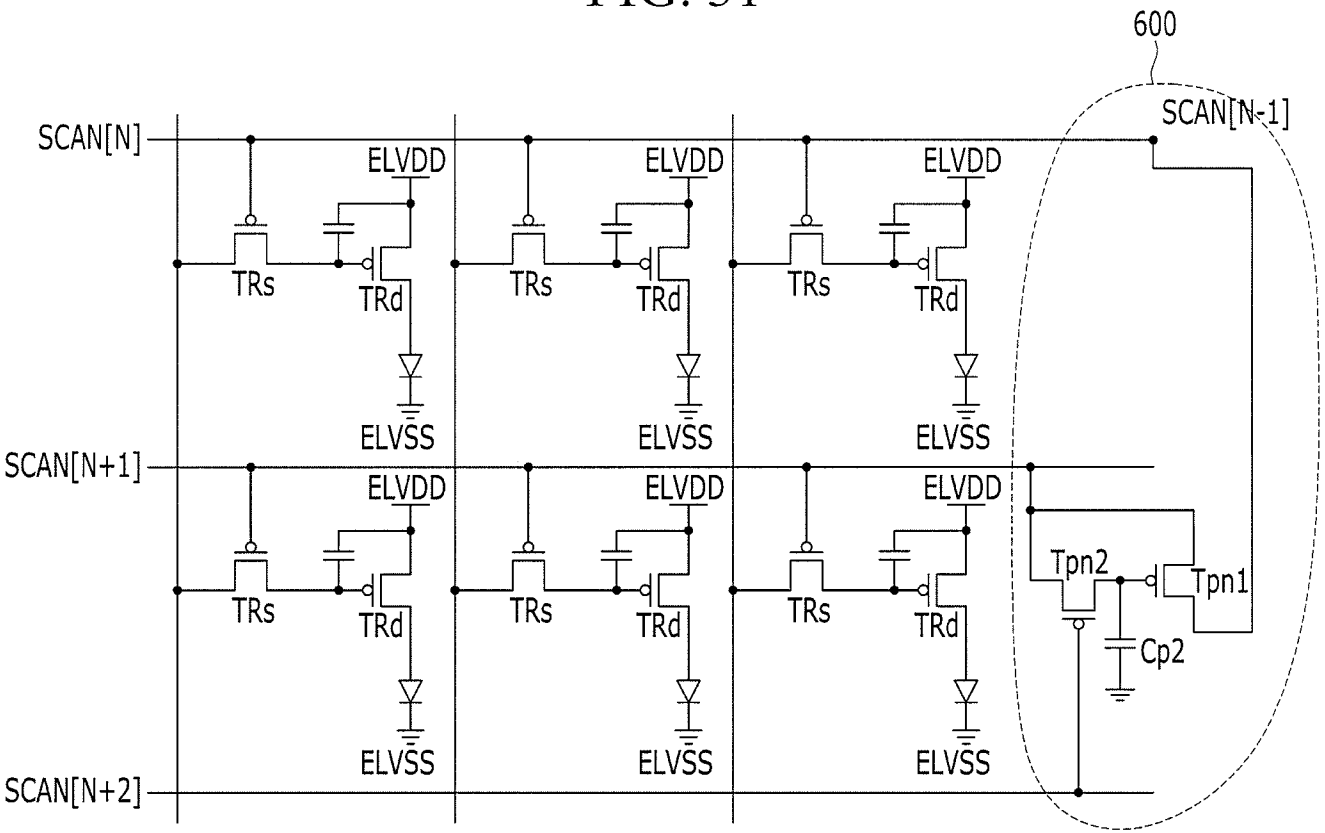
FIG. 31 illustrates examples of pixels of a display panel.

FIG. 31 illustrates another embodiment of pixels of a display panel. Unlike the embodiments of FIGS. 26 and 28, the gate-off voltage applier 600 includes two transistors and one capacitor in the embodiment of FIG. 31.

The organic light emitting diode panel in FIG. 26 includes pixels arranged in a matrix of rows and columns. Each pixel includes a switching transistor TRs, a driving transistor TRd, and a light emitting diode (LED). The switching transistor TRs has a gate terminal connected to a gate line, a source terminal connected to a data line, and a drain terminal connected to a gate terminal of the driving transistor TRd. The driving transistor TRd has a source terminal connected to the power source voltage ELVDD, and a drain terminal connected to one terminal of the organic light emitting diode. A capacitor may be connected between the gate terminal and the source terminal of the driving transistor TRd. A low-level voltage ELVSS is connected to the other terminal of the organic light emitting diode.

In FIG. 31, the pixel structure of an organic light emitting diode panel is illustrated, and the pixels may have various circuit structures. In the embodiment of FIG. 31, one gate-off voltage applier 600 is connected to each gate line per unit pixel. The gate-off voltage applier 600 applies a voltage for turning off the switching transistor TRs, and includes a first gate-off voltage applying transistor Tpn1, a second gate-off voltage applying transistor Tpn2, and a capacitor Cpn2.

A gate line of a previous stage is connected to a source terminal of the first gate-off voltage applying transistor Tpn1 in the gate-off voltage applier 600, a gate line of the present stage is connected to a drain terminal, and a gate terminal thereof is connected to a first node. The gate line of the present stage is connected to a source terminal of the second gate-off voltage applying transistor Tpn2. Also, the second gate-off voltage applying transistor Tpn2 has a drain terminal connected to the first node and a gate terminal connected to a gate line of a next stage. The capacitor Cpn2 is formed between the first node and a ground terminal.

The structure of this gate-off voltage applier 600 according to the embodiment of FIG. 31 may be the same as that of the gate-off voltage applier 600 according to the embodiment of FIG. 21. Accordingly, in the embodiment of FIG. 31, gate signals of the waveforms similar to those of FIG. 22 may be applied. However, unlike the embodiment of FIG. 22, it may be applied to the structure of FIG. 31 by changing the gate-off voltage and the gate-on voltage to the high-level voltage and low-level voltage.

Similar to the embodiments of FIGS. 21 and 22, it is possible to solve the problem caused by the signal delay in the case of the gate-off voltage applier 600 according to the embodiment of FIG. 31.

Figure 32:
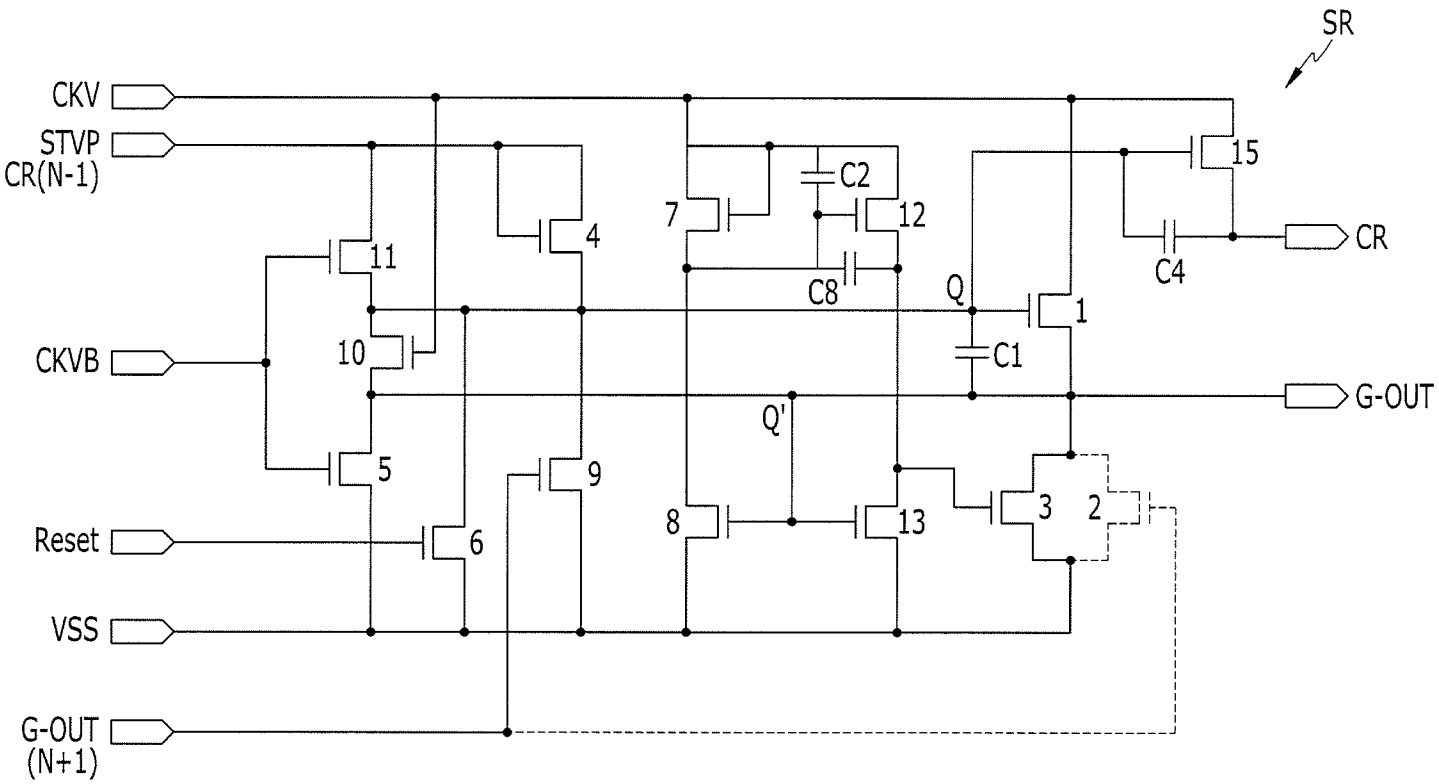
FIGS. 32 to 34 respectively illustrate embodiments of one stage of a gate driver of a display panel.
Figure 33:
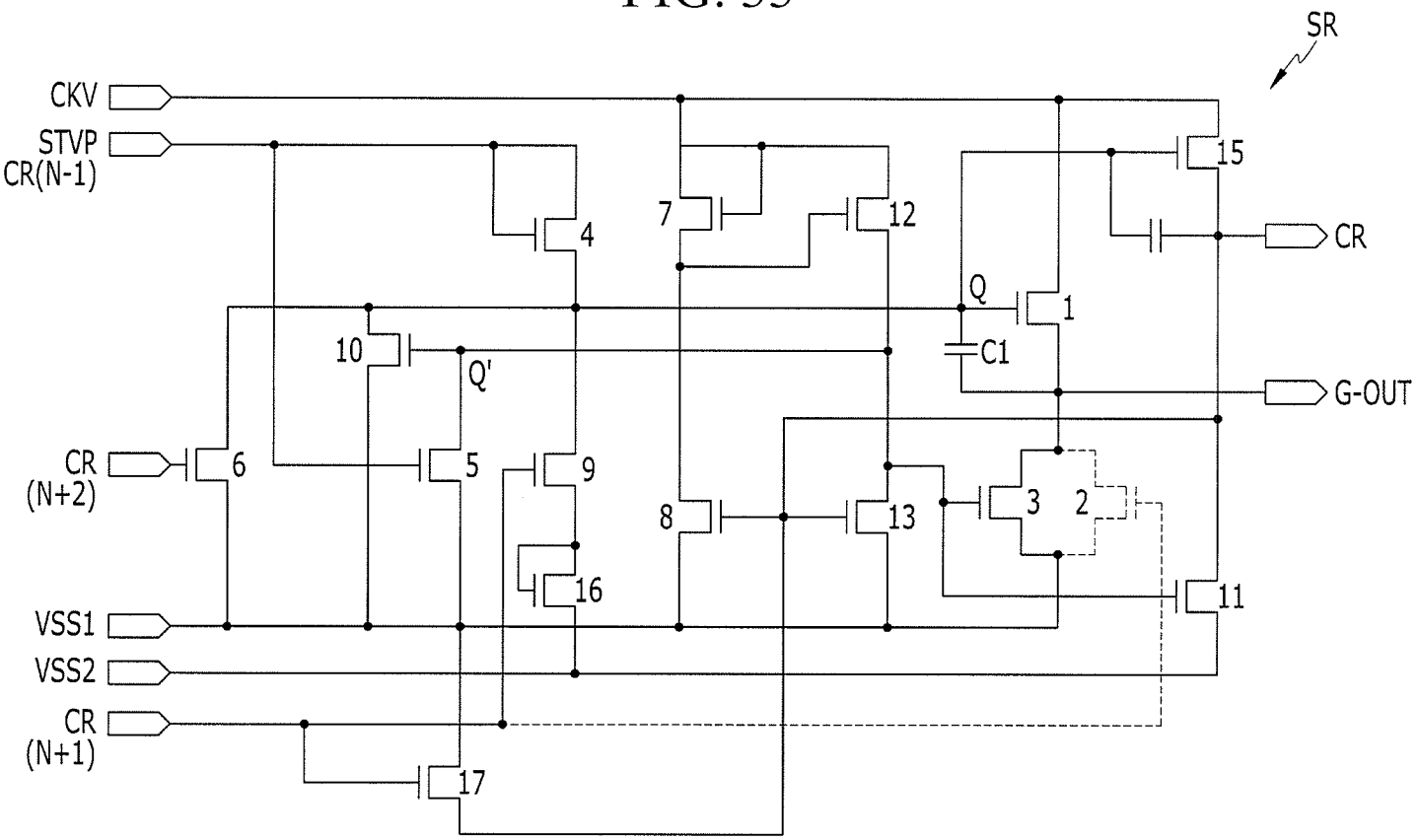
Figure 34:
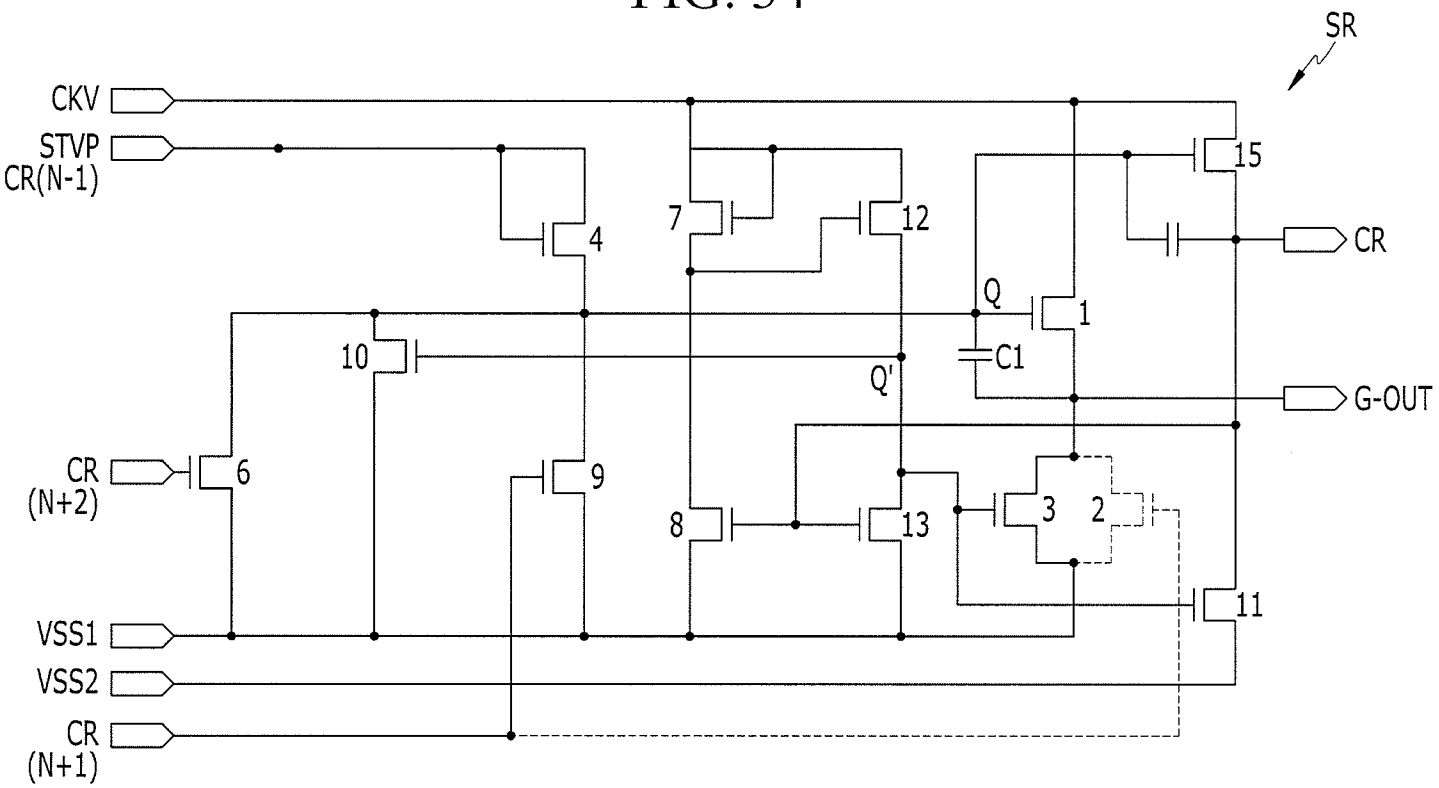

FIGS. 32 to 34 illustrate another embodiment in which the gate-on voltage is sequentially applied from gate drivers 400 and 400-1 to each gate line. FIGS. 32 to 34 illustrate circuits of each stage, which are manufactured with the pixels of the display panel, for example, using a same process.

More specifically, FIGS. 32 to 34 respectively illustrate one stage of a gate driver of a display panel. Referring to FIG. 32, each stage SR of the gate driver 400 includes an input section, a transmission signal generator, an output section, an inverter, and a pull-down driver. The input section includes a fourth transistor 4. An input terminal and a control terminal of the fourth transistor 4 are commonly connected (diode-connected) to a first input terminal CR N−1 of the stage SR which receives a carry signal of a previous stage. An output terminal of the fourth transistor 4 is connected to a node Q. The input section transfers the high-level voltage, that is applied to the first input terminal, to the node Q.

The transmission signal generator includes a fifteenth transistor 15 and a fourth capacitor C4. A clock signal is input into an input terminal of the fifteenth transistor 15 through a first clock terminal CKV of the stage SR, a control terminal of the fifteenth transistor 15 is connected to an output (i.e., the node Q of the input section), and the control terminal and an output terminal of the fifteenth transistor 15 is connected to the fourth capacitor C4. The transmission signal generator outputs a transmission signal CR according to the voltage and the clock signal at the node Q.

The output section includes a first transistor 1 and a first capacitor C1. The first transistor 1 has a control terminal connected to the node Q, and a clock signal is input into an input terminal thereof through the first clock terminal CKV of the stage SR. The control terminal and an output terminal of the first translator 1 is connected to the first capacitor C1. An output terminal of the stage SR is connected to the gate line. The output section outputs a gate voltage according to the voltage and the clock signal at the node Q.

The inverter includes a seventh transistor 7, an eighth transistor 8, a twelfth transistor 12, a thirteenth transistor 13, a second capacitor C2, and a third capacitor C3. The inverter outputs an inverted voltage of the voltage at node Q to a third transistor 3.

The pull-down driver smoothly outputs the gate-off voltage by removing electric charges on the stage SR, and includes all the remaining translators (i.e., second, third, fifth, sixth, ninth, tenth, and eleventh transistors). The pull-down driver lowers an electric potential at the node Q and lowers the voltage output to the gate line. In another embodiment, the pull-down driver may omit the second transistor 2.

In FIG. 32, the terms "CKV," "CKVB," "Reset," "STVP/CR N−1," "VSS," and "G-OUT N+1" respectively indicate the first clock terminal, a second clock terminal, a reset terminal, a first input terminal, a low-level voltage terminal, and a second input terminal. Two inverted clock signals are respectively input into the first clock terminal and the second clock terminal. The carry signal of the previous stage or a start signal STVP is input into the first input terminal. A low-level voltage is constantly input into the low-level voltage terminal. A carry signal of a next stage is input into the second input terminal.

Referring to FIG. 33, each stage SR of the gate driver 400 according to one embodiment includes an input section, a transmission signal generator, an output section, an inverter, and a pull-down driver. The input section includes a fourth transistor 4 having an input terminal and a control terminal commonly connected (diode-connected) to a first input terminal CR N−1 of the stage SR. An output terminal of the fourth transistor 4 is connected to a node Q (e.g., a first node). The input section transfers the high-level voltage, that is applied to the first input terminal, to the node Q.

The transmission signal generator includes a fifteenth transistor 15. A first clock signal and a second clock signal are input into an input electrode of the fifteenth transistor 15 through a clock terminal CKV of the stage SR. A control terminal of the fifteenth transistor 15 is connected to an output, e.g., the node Q of the input section. A transmission signal CR is output to an output terminal of the fifteenth transistor 15. A capacitor may be connected between the control terminal and the output terminal of the fifteenth transistor 15. The output terminal of the fifteenth transistor 15 is connected to the pull-down driver to receive a second low-level voltage Vss2. As a result, when the transmission signal CR has a low level, the voltage is the second low-level voltage Vss2.

The output section includes a first transistor 1 and a first capacitor C1. A control terminal of the first transistor 1 is connected to the node Q. A first clock signal and a second clock signal are input into an input terminal thereof through the clock terminal CKV. A first capacitor C1 is connected between the control terminal and the output terminal thereof, and a gate voltage is output to an output terminal thereof. Further, the output terminal of the first transistor 1 is connected to the pull-down driver to receive a first low-level voltage Vss1. As a result, the gate-off voltage is the first low-level voltage Vss1. This output section outputs a gate voltage according to the voltage and the clock signal at the node Q.

The inverter includes a seventh transistor 7, an eighth transistor 8, a twelfth transistor 12, and a thirteenth transistor 13. The inverter outputs an inverted voltage of the voltage at the node Q. Similar to the embodiment of FIG. 32, the inverter may further include two capacitors. The output of the inverter is output to the third transistor 3 and the eleventh transistor 11.

The pull-down driver smoothly outputs the gate-off voltage by removing electric charges on the stage SR. The pull-down driver decreases the potential of the node Q, the potential of a node Q', the voltage output as the transmission signal CR, and the voltage output to the gate line. The pull-down driver includes all the remaining translators, i.e., second, third, fifth, sixth, ninth, tenth, eleventh, sixteenth, and seventeenth transistors. In another embodiment, the pull-down driver may omit the second transistor 2.

In FIG. 33, the terms "CKV," "STVP/CR N−1," "VSS1 and VSS2," "CR N+1," and "CR N+2" respectively indicate the clock terminal, a first input terminal, a first low-level voltage terminal and a second low-level voltage terminal, a second input terminal, and a third input terminal. A clock signal is input into the clock terminal, a carry signal of a previous stage or a start signal STVP is input into the first input terminal, a carry signal of a next stage is input into the second input terminal, a carry signal of a stage after the next is input into the third input terminal, and different low-level signals are input into the first low-level voltage terminal and the second low-level voltage terminal. In this case, the second low-level voltage is lower than the second low-level voltage.

Referring to FIG. 33, each stage SR of the gate driver 400 according to one embodiment includes an input section, a transmission signal generator, an output section, an inverter, and a pull-down driver. The input section includes a fourth transistor 4. An input terminal and a control terminal of the fourth transistor 4 are commonly connected (diode-connected) to a first input terminal CR N−1 of the stage SR. An output terminal of the fourth transistor 4 is connected to a node Q (e.g., a first node). The input section transfers the high-level voltage, that is applied to the first input terminal, to the node Q.

The transmission signal generator includes a fifteenth transistor 15. A first clock signal and a second clock signal are input into an input electrode of the fifteenth transistor 15 through a clock terminal CKV of the stage SR. A control terminal of the fifteenth transistor 15 is connected to an output, e.g., the node Q of the input section. A transmission signal CR is output to an output terminal of the fifteenth transistor 15. A capacitor may be connected between the control terminal and the output terminal of the fifteenth transistor 15. The output terminal of the fifteenth transistor 15 is connected to the pull-down driver to receive a second low-level voltage Vss2. As a result, when the transmission signal CR has a low level, the voltage is the second low-level voltage Vss2.

The output section includes a first transistor 1 and a first capacitor C1. A control terminal of the first transistor 1 is connected to the node Q. A first clock signal and a second clock signal are input into an input terminal thereof through the clock terminal CKV. A first capacitor C1 is connected between the control terminal and the output terminal thereof, and a gate voltage is output to an output terminal thereof. Further, the output terminal of the first transistor 1 is connected to the pull-down driver to receive a first low-level voltage Vss1. As a result, the gate-off voltage is the first low-level voltage Vss1. This output section outputs a gate voltage according to the voltage and the clock signal at the node Q.

The inverter includes a seventh transistor 7, an eighth transistor 8, a twelfth transistor 12, and a thirteenth transistor 13. The inverter outputs an inverted voltage of the voltage at the node Q. Similar to the embodiment of FIG. 32, the inverter may further include two capacitors. The output of the inverter is outputted to the third transistor 3 and the eleventh transistor 11.

The pull-down driver smoothly outputs the gate-off voltage by removing electric charges on the stage SR. The pull-down driver decreases the potential of the node Q, the voltage output as the transmission signal CR, and the voltage output to the gate line. The pull-down driver includes all the remaining translators, i.e., second, third, sixth, ninth, tenth, and eleventh transistors. In another embodiment, the pull-down driver may omit the second transistor 2.

In FIG. 34, the terms "CKV," "STVP/CR N−1," "VSS1 and VSS2," "CR N+1," and "CR N+2" respectively indicate the clock terminal, a first input terminal, a first low-level voltage terminal and a second low-level voltage terminal, a second input terminal, and a third input terminal. A clock signal is input into the clock terminal, a carry signal of a previous stage or a start signal STVP is input into the first input terminal, a carry signal of a next stage is input into the second input terminal, a carry signal of a stage after the next is input into the third input terminal, and different low-level signals are inputted into the first low-level voltage terminal and the second low-level voltage terminal. In this case, the second low-level voltage is lower than the second low-level voltage. The structures of the stages in FIGS. 32 to 34 are merely exemplary embodiments, and a stage having a different structure may be employed.

By way of summation and review, depending on location in a display panel, gate voltages may have different wave forms due to delay. In accordance with one or more of the aforementioned embodiments, in order to prevent a gate-off voltage from being delayed, an element for converting a gate signal to a gate-off voltage is added in the display panel.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display panel, comprising:

a plurality of gate lines extending in a first direction;

a plurality of data lines extending in a second direction;

a plurality of pixels connected to the plurality of gate lines and the plurality of data lines, a pixel of the plurality of pixels including a switching transistor connected to a gate line and a data line; and a voltage applier connected to a gate line of a present stage, the voltage applier to apply a voltage after conversion of a gate-on voltage to a gate-off voltage has started, wherein the voltage is closer to the gate-off voltage than the gate-on voltage, wherein the voltage applier includes a transistor having a control terminal connected to a control wire to transmit a gate-off voltage applying signal, and the control wire is disposed between adjacent pixel columns.

2. The display panel as claimed in claim 1, wherein the transistor further includes:

a source terminal to receive the gate-off voltage, and a drain terminal connected to the gate line of the present stage.

3. The display panel as claimed in claim 2, wherein the gate-on voltage applied to the gate line of the present stage partially overlaps a gate line at a previous stage of the gate line of the present stage or a gate line at a next stage.

4. The display panel as claimed in claim 2, wherein the control wire that is to transmit the gate-off voltage applying signal includes:

an odd-numbered control wire to control the voltage applier connected to an odd-numbered gate line, and an even-numbered control wire to control the voltage applier connected to an even-numbered gate line.

5. The display panel as claimed in claim 2, wherein the control wire that is to transmit the gate-off voltage applying signal includes:

a first control wire, a second control wire, and a third control wire, wherein gate-off voltage applying signals that are applied to the first control wire, the second control wire, and the third control wire do not overlap each other.

6. The display panel as claimed in claim 2, wherein the control wire is parallel with the data line.

7. The display panel as claimed in claim 2, wherein the pixel includes a liquid crystal capacitor.

8. The display panel as claimed in claim 2, wherein the pixel includes a driving transistor and a light emitting diode.

9. The display panel as claimed in claim 1, wherein the pixel includes a driving transistor and a light emitting diode (LED), and wherein one end of the driving transistor is coupled to receive a power source voltage.

10. The display panel as claimed in claim 9, wherein a voltage level of the gate-on voltage is lower than that of the gate-off voltage.

11. The display panel as claimed in claim 1, wherein the voltage applier includes at least one voltage applier connected to the gate line of the present stage.

* * * * *